US006811333B2

(12) United States Patent
Sumi et al.

(10) Patent No.: US 6,811,333 B2
(45) Date of Patent: Nov. 2, 2004

(54) THERMAL DEVELOPMENT APPARATUS

(75) Inventors: Makoto Sumi, Hachioji (JP); Mamoru Umeki, Hachioji (JP); Kazuhiro Kido, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 0 days.

(21) Appl. No.: 10/742,328

(22) Filed: Dec. 19, 2003

(65) Prior Publication Data

US 2004/0136707 A1 Jul. 15, 2004

(30) Foreign Application Priority Data

Dec. 25, 2002 (JP) ..... 2002-373773
Jan. 10, 2003 (JP) ..... 2003-004162

(51) Int. Cl.[7] ..... G03D 13/00

(52) U.S. Cl. ..... 396/575; 219/216

(58) Field of Search ..... 396/571, 575; 355/27, 30, 400–406; 219/216; 250/316.1, 317.1, 318, 319

(56) References Cited

U.S. PATENT DOCUMENTS 5,975,772 A * 11/1999 Imai et al. ..... 396/575
6,297,476 B1 * 10/2001 Kashino et al. ..... 219/216
6,309,114 B1 * 10/2001 Torisawa et al. ..... 396/575
2004/0080605 A1 * 4/2004 Sumi et al. ..... 347/207

* cited by examiner

*Primary Examiner*—D. Rutledge
(74) *Attorney, Agent, or Firm*—Cantor Colburn LLP

(57) ABSTRACT

A thermal development apparatus includes a heating drum and rollers. The heating drum with a smooth layer having an arc shaped portion of an outer circumferential surface heats and carries photothermographic imaging material being in contact with the arc-shaped portion, and opposed rollers arranged in line along a carrying path of the material presses the material to the outer circumferential surface of the arc-shaped portion. When R (mm) denotes radius of arc-shaped portion, r (mm) denotes radius of opposed rollers, $\alpha$ (degree) denotes angle between lines respectively connecting center of arc-shaped portion and centers of two opposed rollers adjacent to each other, P (mm) denotes pitch of opposed rollers, and $\beta$ (degree) denotes contact angle of material to opposed roller, $P=2\pi R\alpha/360$, $2r+3 \geqq P>2r$, and $\beta \leqq 60$ are satisfied.

13 Claims, 20 Drawing Sheets

THERMAL DEVELOPMENT APPARATUS

BACKGROUND OF THE INVENTION

1. Field of the Invention

The present invention relates to a thermal development apparatus for heating and developing photothermographic imaging material.

2. Description of Related Art

In a thermal development process for heating and developing a photothermographic imaging film (hereinafter, simply named "film"), as disclosed in Japanese Translation of PCT Patent Application (Tokuhyohei) No. H10-500497, a member obtained by coating a surface layer of a heating drum with an elastic member (silicon rubber) having heat resistance and high thermal conductivity has been put to practical use as a heating means for heating the film.

Particularly, in a thermal development unit for developing a silver salt photothermographic imaging film obtained by using the organic solvent, when the film is developed, a surface active agent of a surface layer of the film and/or the organic solvent or an organic acid of an emulsion layer are liberated from the film and attach to an elastic member (silicon rubber) forming the surface layer of the heating drum. Therefore, the elastic member (silicon rubber) deteriorates, and the swelling and abrasion of the elastic member (silicon rubber) is generated. Accordingly, a problem is arisen that the finished image having a stable quality cannot be obtained.

To solve the problem, in the Published Japanese Patent Application (Tokugan) No. 2002-208438, there is a technique of coating the surface layer made of the elastic member (silicon rubber) having the high thermal conductivity with fluororesin such as Teflon (trade name) to prevent the elastic member (silicon rubber) of the high thermal conductivity from being attacked by the surface active agent included in the surface layer of the film and/or the organic solvent or the organic acid of the emulsion layer in the developing of the film. This technique prevents the elastic member such as silicon rubber from gradually deteriorating with the elapsing of time. Accordingly, the finished image of the stable quality can be obtained.

However, when the surface of the elastic layer is coated with the fluororesin, though the lengthened life time of the heating drum and the lengthened cycle of the cleaning and maintenance of the heating drum can be achieved, there are following problems peculiar to the fluororesin.

(1) The carrying force caused by the low friction factor is insufficient.
(2) The development is made inactive because of the lowering of the thermal conductivity.
(3) The film is not tightly in contact with the drum in an axial direction of the drum, and a certain volume of air layer is generated between the film and the drum.

The problem (1) will be described hereinafter. As is well-known, Teflon (trade name) is the material having a low friction factor and is used as a sliding member. Therefore, when the nipping pressure of the opposed rollers arranged around the heating drum is set in the same condition as that in case of the heating drum with the elastic member of silicon rubber, the film carrying force during the thermal development drastically lowered, and there is a probability that the film slips on the drum. The slipping of the film causes the lengthening of the entire development period of time practically. This may cause a change in the density of the image, wrinkles or damage on the surface of the film.

The advance of the development of the photothermographic imaging film is determined by the product of the heating temperature and the heating time. Therefore, when the constant heating time, in other words, the constant film carrying speed is not maintained during the carrying from the top to the end of the film, the unevenness in the density of the image occurs. Therefore, in the thermal development apparatus having the heating drum with the surface layer made of the elastic member such as silicon rubber corresponding to the earlier art, to prevent the unevenness in the density of the image and the unevenness of wrinkles, the carrying speed in the thermal development unit and the carrying speeds on the upstream and downstream sides of the thermal development unit are set to the relation of (carrying speed on upstream side)<(carrying speed in thermal development unit)<(carrying speed on downstream side).

The problems (2) and (3) will be described hereinafter. The effective supplying of heat energy to the photothermographic imaging film, the obtaining of the finished image of the desired density and the suppression of the photographic fog on the film in the thermal development apparatus are achieved by thermally developing and carrying the film while pressing the film on the surface of the elastic member (silicon rubber) of the high thermal conductivity by the opposed rollers. However, because the thermal conductivity of Teflon (trade mark) is approximately one-third of that of the elastic member used in the earlier art, the inactiveness of the development occurs in the film when layer of Teflon is excessively thick, and the finished image having the desired density cannot be obtained.

Further, when the film is nipped between the opposed roller and the heating drum having the silicon rubber layer on its surface, even though the parallel relation between the heating drum and the opposed roller is not obtained in the axial direction of the heating drum in some degree of precision, the elastic layer of silicon rubber makes the film be able to uniformly and be tightly in contact with the heating drum and the opposed roller. On the other hand, in case of the existence of the surface layer coated with Teflon (trade mark), when the nipping pressure of the opposed roller and the parallelism are set in the same condition as those in the case of the heating drum with the silicon rubber, there is a probability that the film is not uniformly and tightly in contact with the heating drum and the opposed roller. Therefore, while considering the problem (1), it is important to optimize the biasing force of the opposed rollers and the alignment between the heating drum and each opposed roller, with more emphasis of the tight contact of the film with the heated surface than that in the earlier art.

Because the air layer is generated between the drum and the film due to the non-tight contact of the film with the drum in the axial direction of the drum, the heat transfer from the drum to the film further deteriorates in case of the coating of the drum with fluororesin, and the density in the final image is undesirably lowered. In case of the use of the drum coated with fluororesin, it was found out by the experiment of the inventors that there is/are a steep change(s) in the distribution of temperatures in the neighborhood of the surface of the drum, as compared with the case of the use of the drum coated with silicon rubber. Therefore, when the contact of the film with the drum is not sufficient, the heating of (or the heat transfer to) the film is changed, and the unevenness in the density of the image is enlarged as compared with that in the earlier art. Accordingly, the tight contact of the film F with the heated surface must be emphasized as compared with in the earlier art, and it is important to optimize the biasing force of the opposed rollers and the alignment between the heating drum and each opposed roller.

Further, when the number of opposed rollers is small in the opposed roller method, it is difficult that the film is tightly in contact with the drum at a curvature of the drum surface in the carrying direction. Particularly, a small volume of vacancy is formed between the drum and the opposed roller each time the film faces the opposed roller, and the unevenness in the density of the image can be easily formed.

In case of the use of the drum coated with fluororesin, it was found out by the experiment of the inventors that there is/are a steep change(s) in the distribution of temperatures in the neighborhood of the surface of the drum, as compared with the case of the use of the drum coated with silicon rubber. Therefore, when the contact of the film with the drum is not sufficient, the heating of (or the heat transfer to) the film is changed, and the unevenness in the density of the image is enlarged as compared with that in the earlier art. Accordingly, the tight contact of the film F with the heated surface must be emphasized as compared with in the earlier art, and it is important to optimize the biasing force of the opposed rollers and the alignment between the heating drum and each opposed roller. Further, in view of characteristics of the drum coated with fluororesin, it is required to optimize the number of opposed rollers.

SUMMARY OF THE INVENTION

In order to solve the above problem, a main object of the present invention is to provide a thermal development apparatus, in which photothermographic imaging material is stably carried while being tightly in contact with a heating section, when the heating section has a smooth layer made of fluororesin or the like on its surface, and the unevenness in the density of an image, particularly, the unevenness in the density at a top of the photothermographic imaging material is prevented.

A subordinate object of the present invention is to provide a thermal development apparatus, in which photothermographic imaging material is tightly in contact with a heating section used to heat and develop the photothermographic imaging material while carrying the photothermographic imaging material, when the heating section has a smooth layer made of fluororesin or the like on its surface, and the unevenness in the density of an image is reduced.

In order to accomplish the above-mentioned main object, in accordance with the first aspect of the present invention, a thermal development apparatus comprises:

a heating section, which has at least a portion of its outer surface formed in an arc shape and has a smooth layer on outermost surface of the arc-shaped portion, for carrying photothermographic imaging material being in contact with the smooth layer on the arc-shaped portion while heating the photothermographic imaging material; and a plurality of opposed rollers, arranged along a carrying path of the photothermographic imaging material carried by the smooth layer on the arc-shaped portion of the heating section, for pressing the photothermographic imaging material against the arc-shaped portion, wherein following formula and relations $$P=2\pi R\alpha/360,$$

$$2r+3\geqq P>2r, \text{ and}$$

$$\beta\leqq 60$$

are satisfied when R (mm) denotes a radius of the arc-shaped portion, r (mm) denotes a radius of the opposed rollers, $\alpha$ (degree) denotes an angle between lines respectively connecting a center of the arc-shaped portion and centers of the two opposed rollers adjacent to each other, P (mm) denotes a pitch of the opposed rollers, and $\beta$ (degree) denotes a contact angle of the photothermographic imaging material to the opposed roller.

In the first aspect of the present invention, when the heating section (heating member) has the smooth layer (surface layer) made of fluororesin on the surface of the heating section, the photothermographic imaging material can be tightly in contact with the outer surface of the heating section and be carried while the photothermographic imaging material is pressed on the heating section between the opposed roller (pressing roller) and the heating section. The photothermographic imaging material can be stably carried, and the unevenness in the density of the image specifically on the top side of the material in the carrying direction can be prevented.

Preferably, the heating section comprises:

a base body;

an elastic layer arranged around the base body and made of an elastic member having thermal conductivity equal to or higher than 0.5 W/k and JIS-A stiffness ranging from 20 degrees to 70 degrees; and the smooth layer formed on the outer surface of the elastic layer and coated with fluororesin.

Preferably, a nipping force of each opposed roller in pressing the photothermographic imaging material to the outer surface of the smooth layer of the heating section ranges from 0.06N/cm to 1N/cm.

Preferably, a thickness of the smooth layer of the heating section ranges from 10 $\mu$m to 100 $\mu$m.

Preferably, the opposed rollers are supported together by a supporting member, and a position of the supporting member is adjustable relatively to the arc-shaped portion of the heating section.

In this invention, the parallelism between the heating section and each opposed roller in the axial direction of the heating section formed in the arc shape can be appropriately adjusted. Accordingly, the photothermographic imaging material can be tightly and uniformly in contact with the outer surface of the heating section.

In order to accomplish the above-mentioned subordinate object, in accordance with the second aspect of the present invention, a thermal development apparatus comprises:

a heating section, having a predetermined curvature, for heating photothermographic imaging material; and a plurality of opposed rollers arranged along an axial line of the heating section so as to press the photothermographic imaging material to the heating section, the photothermographic imaging material being developed while being carried between the heating section and each opposed roller, wherein the heating section comprises:

a base body having the predetermined curvature;

an elastic layer arranged around the base body; and a smooth layer arranged on an outer surface of the elastic layer, and wherein parallelism between each opposed roller and the heating section is adjusted within a predetermined amount so that each departure of the opposed rollers from an outer surface of the heating section is kept equal to or lower than a predetermined value.

In the second aspect of the present invention, each opposed roller is arranged at a relative position to the heating section on condition that the parallelism between the opposed roller and the heating section is set so as to make the departure of the opposed roller from the outer surface (smooth layer) of the heating section be equal to or lower than a predetermined value. Accordingly, the photothermographic imaging material can be tightly in contact with the heating section, and the unevenness in the density of the image can be prevented.

Preferably, the smooth layer of the heating section is made of fluororesin.

In this invention, the deterioration of the elastic layer, for example, made of silicon rubber caused by gas released from the photothermographic imaging material in the developing of the film can be prevented. In case of the heating section having the smooth layer made of fluororesin, the tight in contact of the photothermographic imaging material with the heating section is especially required. Because the requirement for the parallelism is satisfied as described above, the unevenness in the density of the image can be prevented.

Preferably, a nipping force of each opposed roller in pressing the photothermographic imaging material to the heating section ranges from 0.06N/cm to 1N/cm.

In this invention, The nipping force can be controlled by adjusting the biasing force of a biasing force generating means for making the opposed roller press the photothermographic imaging material to the heating section. Accordingly, the photothermographic imaging material can be tightly in contact with the smooth layer of the heating section.

Preferably, a film thickness of the smooth layer ranges from 10 $\mu$m to 100 $\mu$m.

In this invention, when the film thickness of the smooth layer is equal to or larger than 10 $\mu$m, the adverse influence of gas of the elastic layer placed under the smooth layer in the developing can be prevented. When the film thickness of the smooth layer is equal to or smaller than 100 $\mu$m, the unevenness in the density of the image hardly occurs.

Preferably, the opposed rollers are supported together by a supporting member, and a position of the supporting member is adjustable relatively to the heating section.

In this invention, the parallelism between each opposed roller and the heating section (deviation of each opposed roller from the heating section) can be appropriately adjusted. Accordingly, the photothermographic imaging material can be tightly and uniformly in contact with the heating section.

The predetermined value of the departure is preferably equal to or lower than 10 $\mu$m when a film thickness of the smooth layer is equal to 100 $\mu$m. The predetermined value of the departure is preferably equal to or lower than 14 $\mu$m when a film thickness of the smooth layer is equal to 50 $\mu$m. The predetermined value of the departure is preferably equal to or lower than 18 $\mu$m when a film thickness of the smooth layer is equal to 30 $\mu$m.

In this invention, the unevenness in the density of the image can be reliably prevented.

BRIEF DESCRIPTION OF THE DRAWINGS

The present invention will become more fully understood from the detailed description given hereinbelow and the accompanying drawing which are given by way of illustration only, and thus are not intended as a definition of the limits of the present invention, and wherein.

PREFERRED EMBODIMENTS OF THE INVENTION

Figure 1:
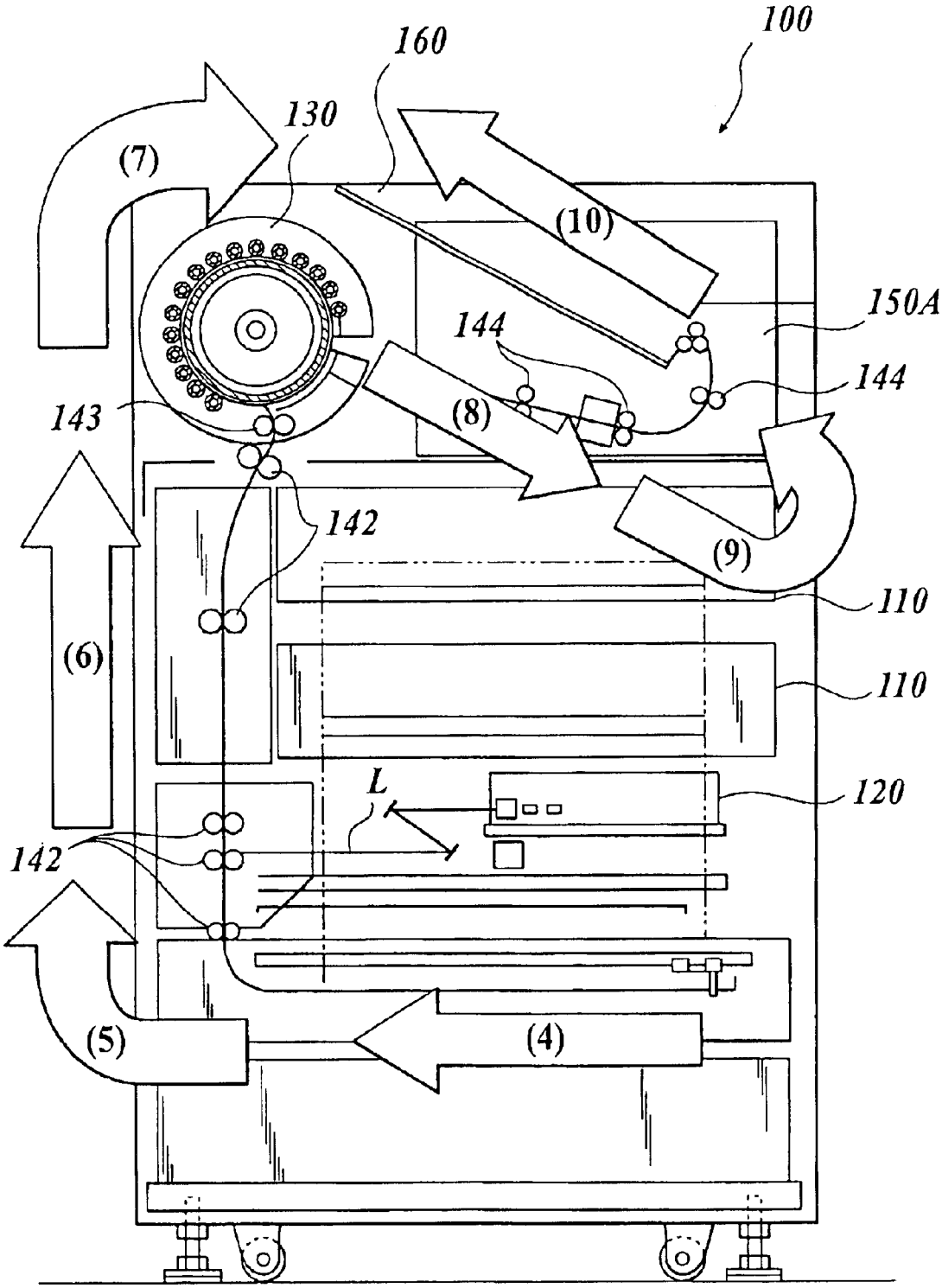
FIG. 1 is a front view schematically showing a thermal development apparatus according to the embodiment of the present invention.

Hereinafter, the embodiment of the present invention will be explained with reference to the drawings. FIG. 1 is a front view schematically showing a thermal development apparatus according to the embodiment of the present invention, and FIG. 2 is a left side view of the thermal development apparatus shown in FIG. 1.

Figure 2:
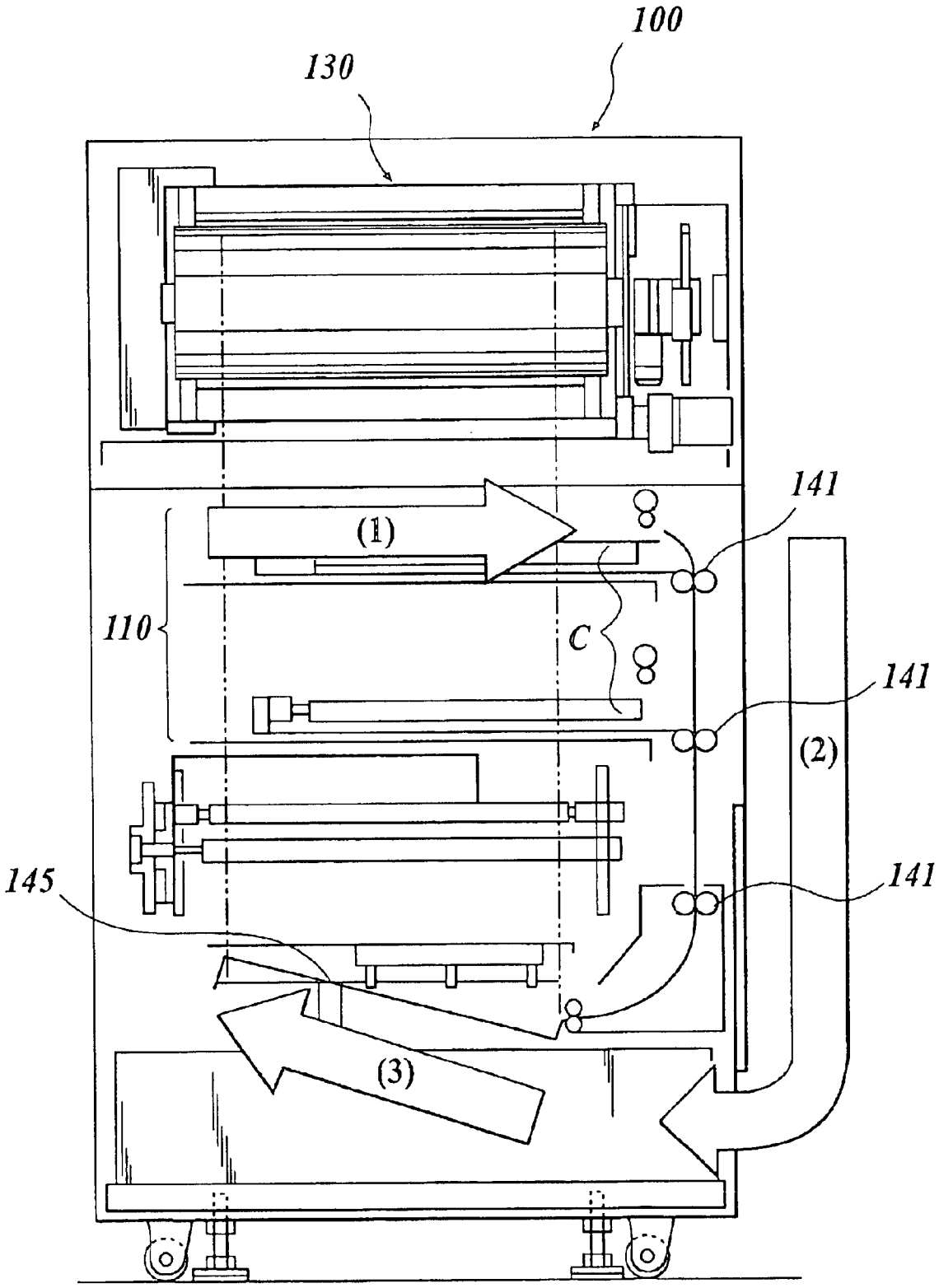
FIG. 2 is a left side view of the thermal development apparatus shown in FIG. 1.

As shown in FIGS. 1 and 2, a thermal development apparatus 100 comprises a carrying section 110 for carrying a plurality of sheets of film F denoting the photothermographic imaging material formed in a sheet shape one by one, an exposure section 120 for exposing the carried film F, and a thermal development section 130 for developing the exposed film F. The thermal development apparatus 100 will be described with reference to FIGS. 1 and 2.

In FIG. 2, the carrying section 110 is divided into an upper stage and a lower stage. In each stage, a plurality of sheets of film F put into a case C are stored. The sheets of film F are taken out from the case C one by one by a taken-out device (not shown) and are drawn out in a direction (horizontal direction) indicated by an arrow (1) of FIG. 2. The film F drawn out from the case C is carried in a direction (lower direction) indicated by an arrow (2) of FIG. 2.

The film F carried to the bottom of the carrying section 110 is further carried to a carrying direction changing section 145 placed in a lower portion of the carrying section 110, and the carrying direction of the film F is changed in the carrying direction changing section 145 (an arrow (3) of FIG. 2 and an arrow (4) of FIG. 1) to proceed to an exposure preparing stage. Further, the film F is carried from the left side of the carrying section 110 in a direction (upper direction) indicated by an arrow (5) of FIG. 1 by a carrying device 142 comprising a pair of rollers. At this time, the film F is scanned and exposed by/to a laser beam L of the infrared ray band from 780 nm to 860 nm in the exposure section 120.

When the film F receives the laser beam L, a latent image is formed in the film F. Thereafter, the film F is carried in a direction (upper direction) indicated by an arrow (6) of FIG. 1. When the film F arrives at a pair of supply rollers 143, the film F is immediately supplied to a heating drum 14. That is, the film F is supplied to the heating drum 14 in random timing. However, the carrying of the film F may be once stopped when the film F arrives at the pair of supply rollers 143. In this case, the pair of supply rollers 143 has a function of determining the timing of the supply of the film F to the thermal development section 130 rotated at a fixed rotational speed, and the film F may be supplied on the outer circumferential surface of the heating drum 14 by starting the rotation of the pair of supply rollers 143 when a supplied position placed on the heating drum 14 rotated approaches the pair of supply rollers 143. The pair of supply rollers 143 is rotationally driven by the motor 151 while being controlled by a control device 150.

Further, the heating drum 14 is rotated in a direction indicated by an arrow (7) of FIG. 1 while holding the film F on the outer circumferential surface of the heating drum 14. In this state of the heating drum 14, the film F is heated and developed by the heating drum 14, and the latent image is changed to a visible image. Thereafter, when the film F reaches the right position of the heating drum 14, the film F is detached from the heating drum 14, is carried to a cooling and carrying section 150A along a direction indicated by an arrow (8) of FIG. 1, and is cooled. Thereafter, the film F is carried in each of directions indicated by arrows (9) and (10) of FIG. 1 by a plurality of carrying rollers 144*a* (refer to FIG. 5) and 144, and the film F is ejected to an ejection tray so as to be able to take out the film F from the top of the thermal development apparatus 100.

Figure 3:
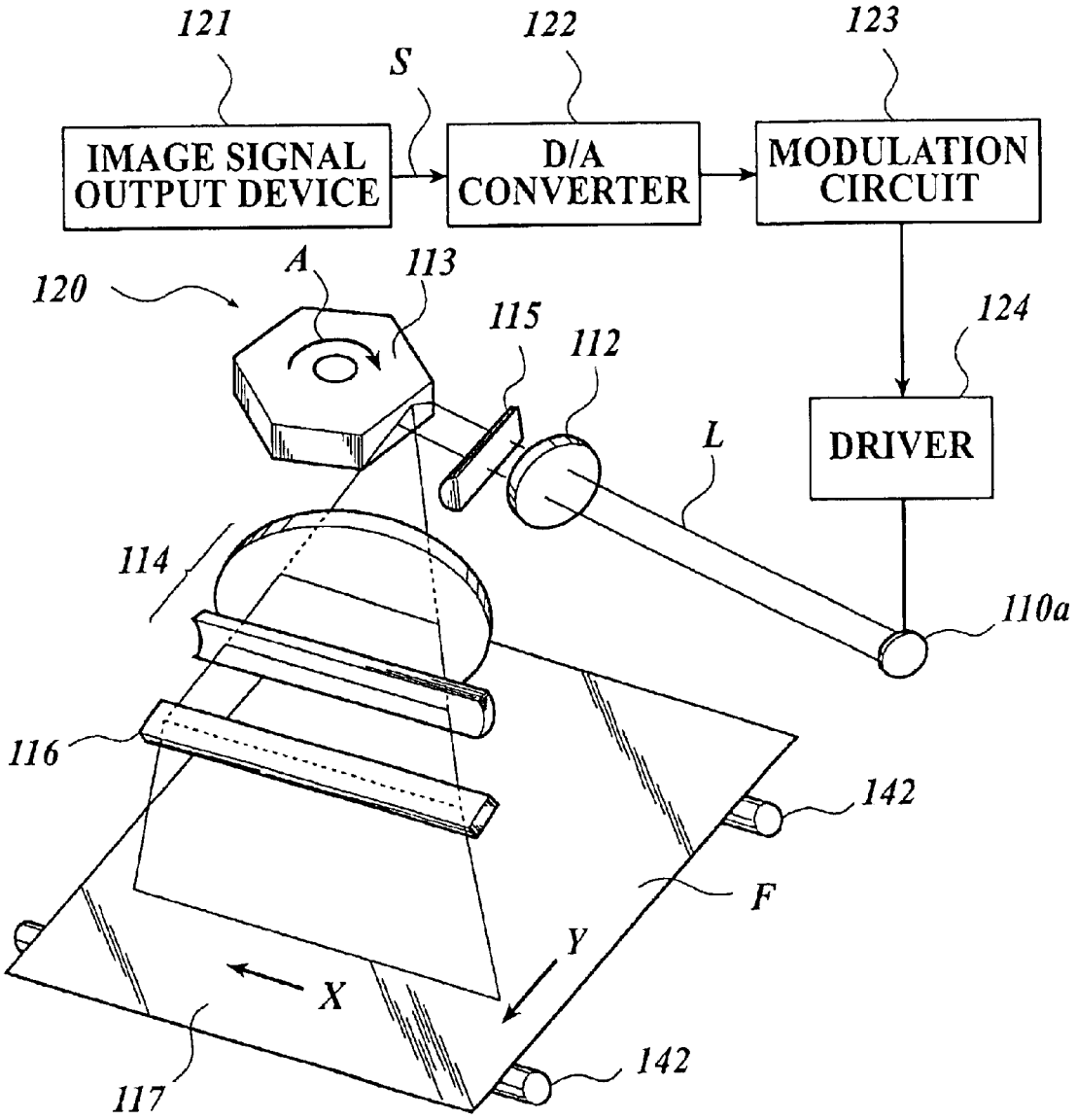
FIG. 3 is a view schematically showing the configuration of an exposure section 120 of the thermal development apparatus shown in FIG. 1.

FIG. 3 is a view schematically showing the configuration of the exposure section 120. The exposure section 120 scans the film F in a main scanning direction by deflecting the laser beam L, having the intensity modulated according to an image signal S, by a rotating polygonal mirror 213. The exposure section 120 also scans the film F in a sub-scanning direction by relatively moving the film F in a direction almost orthogonal to the main scanning direction of the laser beam L. Consequently, the latent image is established within the film F by using the laser beam L.

More detailed structure of the exposure section 120 will be described hereinafter. In FIG. 3, the image signal S denoting a digital signal outputted from an image signal output device 121 is converted into an analogue signal in a digital-to-analog (D/A) converter 122, and then is inputted to a modulation circuit 123. The modulation circuit 123 controls a driver 124 of a laser source 110*a* according to the analogue signal to make the laser source 110*a* emit the modulated laser beam L.

The laser beam L emitted from the laser source 110*a* passes through a lens 112 and is converged only in a vertical direction by a cylindrical lens 115. And then, the converged laser beam L is incident on a rotating polygonal mirror 113, which is rotated in a direction of an arrow A of FIG. 3, as a line image extending in a direction orthogonal to a driving shaft of the mirror 113. The rotating polygonal mirror 113 reflects and deflects the laser beam L in the main scanning direction. The deflected laser beam L passes through an fθ lens 114 which includes a cylindrical lens obtained by combining two lenses, and is reflected by a mirror 116 arranged on an optical path so as to extend in the main scanning direction. And then, a scanned surface 117 of the film F carried by the carrying device 142 in a direction (sub-scanning direction) of an arrow Y is repeatedly scanned with the laser beam L in a direction (main scanning direction) of an arrow X. In other words, the entire scanned surface 117 of the film F is scanned with the laser beam L.

The cylindrical lens of the fθ lens 114 converges the incident laser beam L only in the sub-scanning direction on the scanned surface 117 of the film F. Further, the distance between the fθ lens 114 and the scanned surface 117 is equal to the focal length of the entire fθ lens 114. As mentioned above, the exposure section 120 comprises the fθ lens 114 including the cylindrical lens and the mirror 116, and the laser beam L is once converged only in the sub-scanning direction on the rotating polygonal mirror 113. Accordingly, even when the surface of the rotating polygonal mirror 113 is inclined or even when the axis of the rotating polygonal mirror 113 is deviated, a plurality of scanning lines can be formed at equal intervals without deviating a scanning position of the laser beam L in the sub-scanning direction on the scanned surface 117 of the film F. The rotating polygonal mirror 113 is excellent in view of the stability of scanning as compared with other beam deflectors such as a galvanometer mirror and the like. As mentioned above, the latent image based on the image signal S is formed in the film F.

Figure 7:
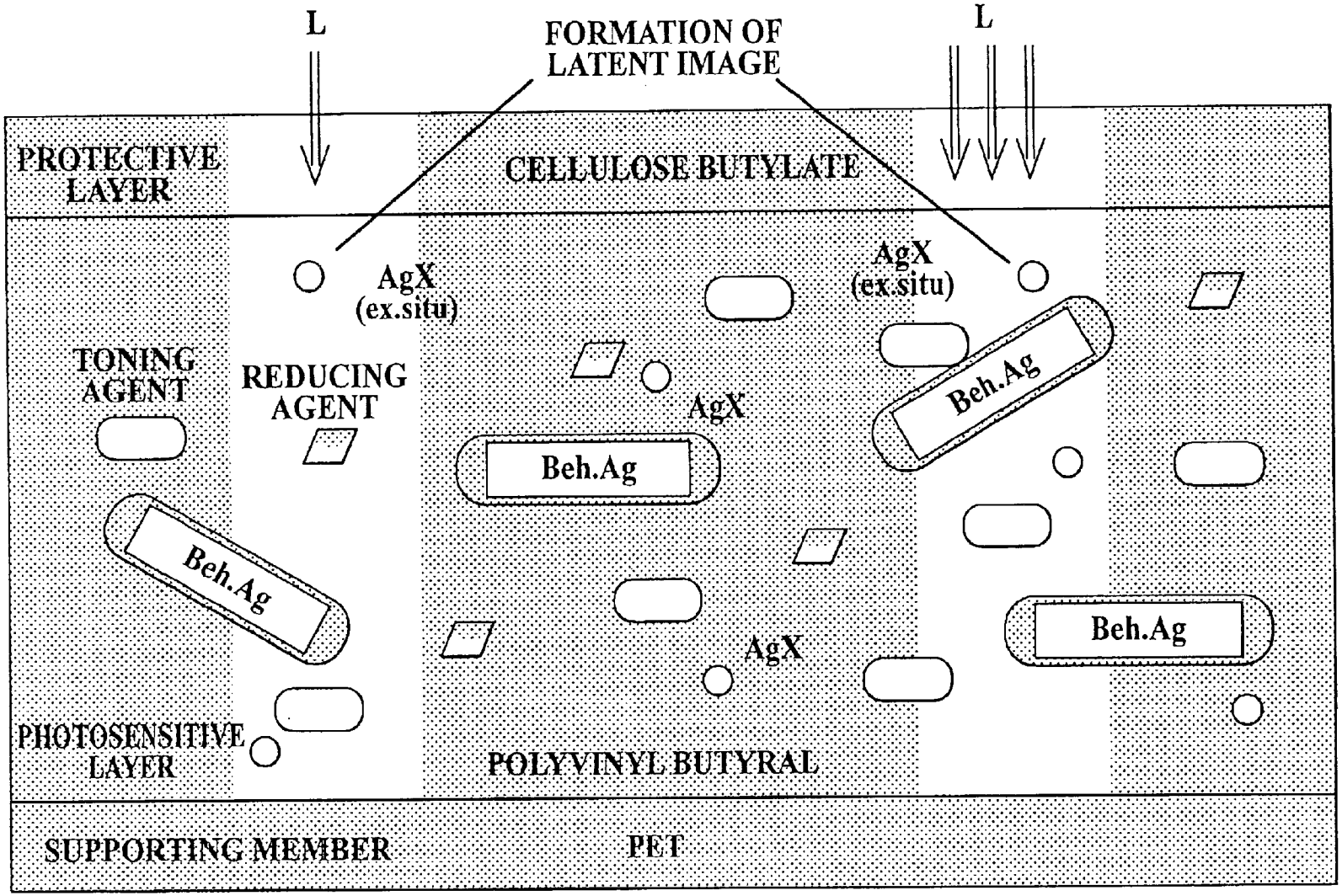
FIG. 7 is a sectional view of a film according to the embodiment and schematically shows the chemical reaction in the film when the film is exposed by a laser beam.

The chemical reaction of forming the latent image in the film F described above will be explained in detail with reference to FIG. 7. FIG. 7 is a sectional view of a film according to the embodiment and schematically shows the chemical reaction in the film when the film is exposed by a laser beam.

In the film F, a photosensitive layer made of heat-resistant binder as a main component is arranged on a supporting member (base layer) made of polyethylene terephthalate (PET), and a protective layer made of heat-resistant binder as a main component is arranged on the photosensitive layer. In the photosensitive layer, halogenated silver particles, behenic acid silver (Beh. Ag) denoting a type of organic acid silver, reducing agent and toning agent are combined with one another. Further, a back surface layer made of heat-resistant binder as a main component is arranged on the back surface of the supporting member.

In the exposure, when the exposure section 120 irradiates the film F with laser beam L, as shown in FIG. 7, the halogenated silver particles are exposed to the laser beam L in the irradiated area, and a latent image is formed in the film F.

Figure 4:
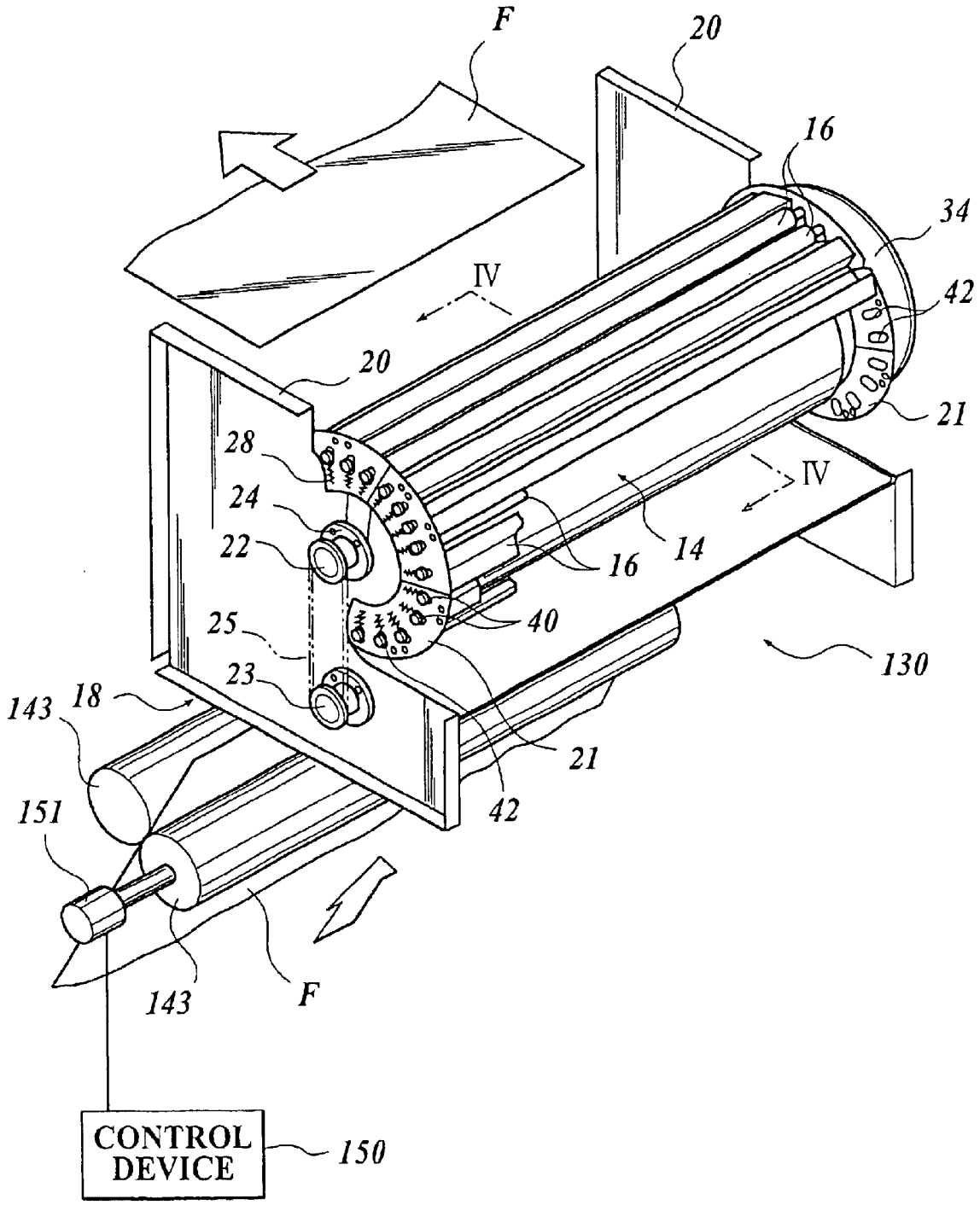
FIG. 4 is a perspective side view of a thermal development section 130 of the thermal development apparatus shown in FIG. 1.
Figure 5:
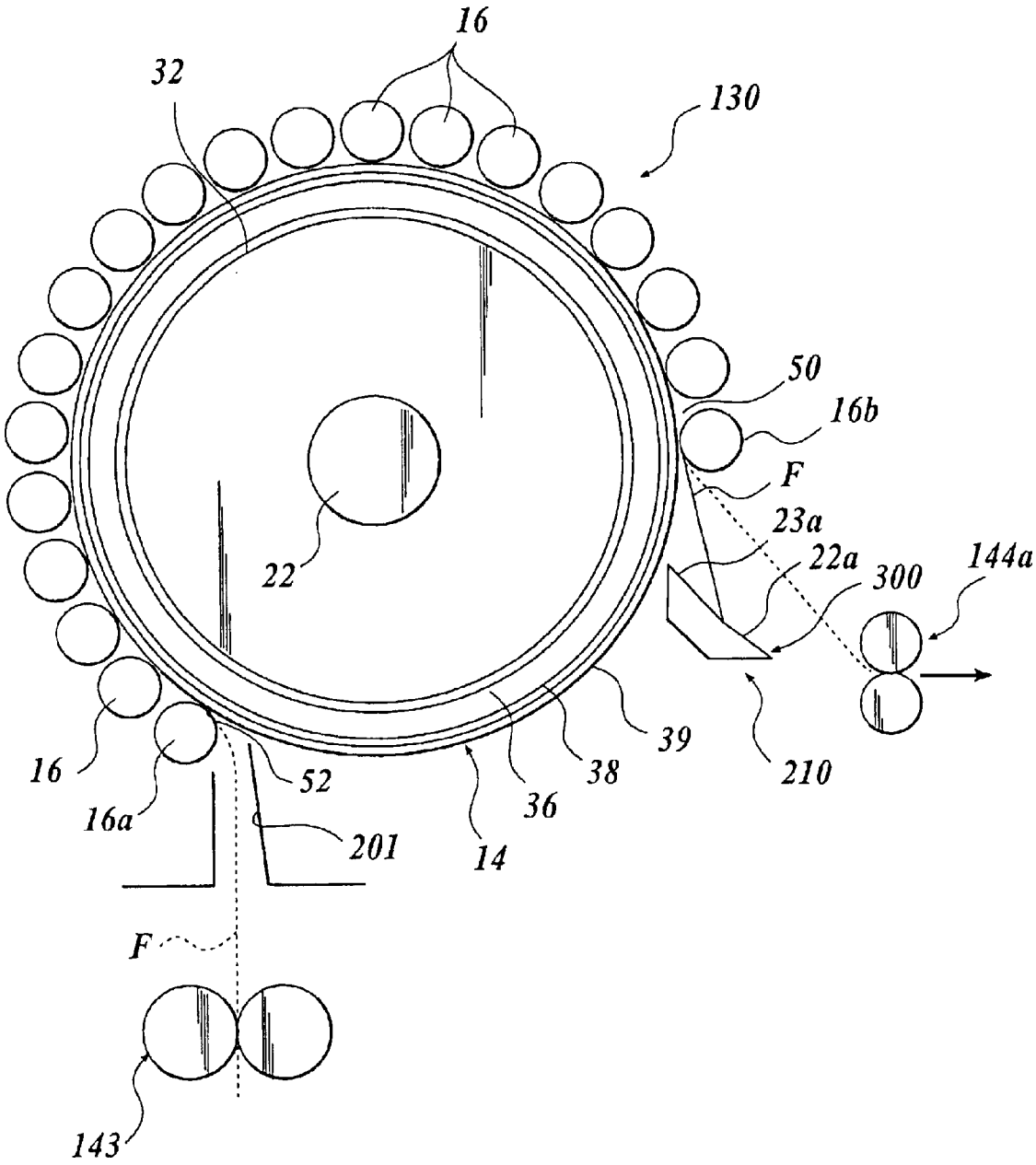
FIG. 5 is a longitudinal sectional view taken substantially along IV—IV line of FIG. 4.
Figure 6:
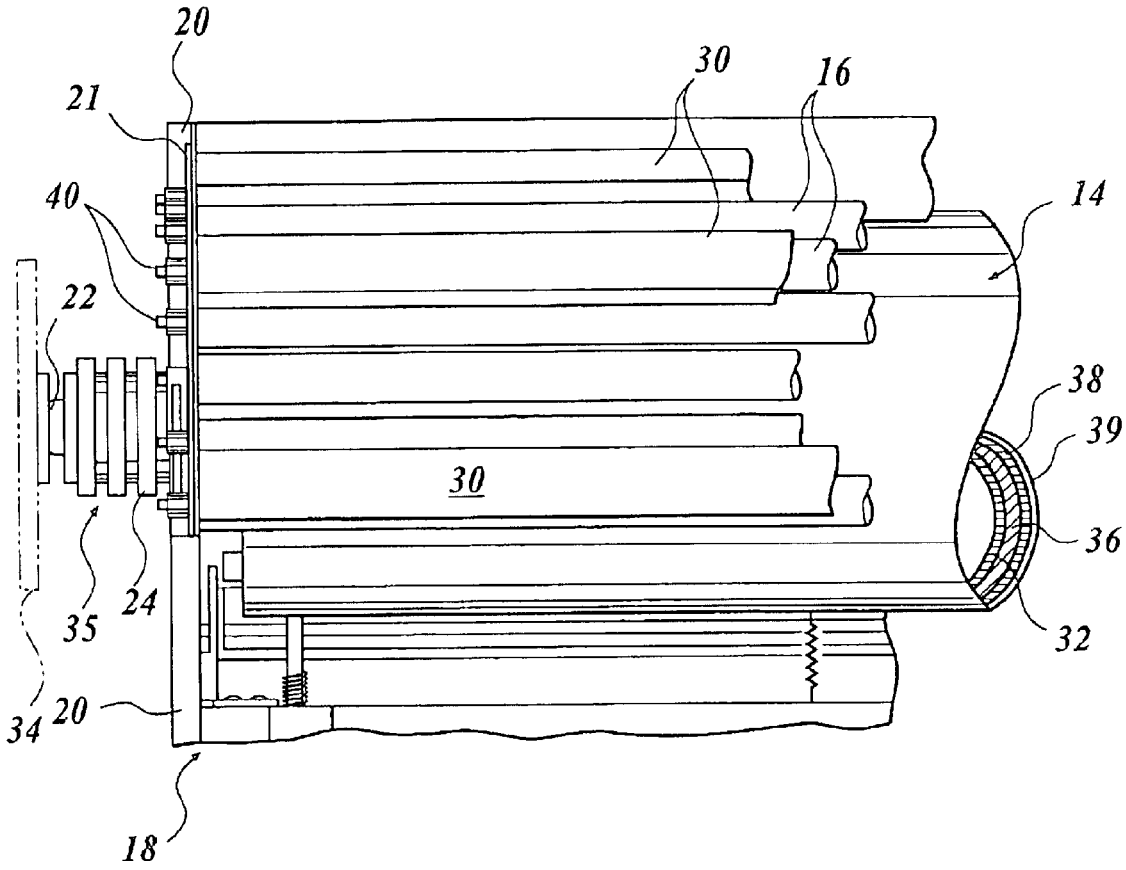
FIG. 6 is a front view of the thermal development section shown in FIG. 4.

FIGS. 4 to 6 show the configuration of the thermal development section 130 for heating the film F. That is, FIG. 4 is a perspective side view of the thermal development section 130, FIG. 5 is a longitudinal sectional view taken substantially along IV—IV line of FIG. 4, and FIG. 6 is a front view of the thermal development section 130 shown in FIG. 4.

The thermal development section 130 has the heating drum 14 acting as a heating member (heating section). The film F is almost tightly in contact with the outer circumferential surface of the heating drum F, and the heating drum F can heat the film F while holding the film F. The heating drum 14 has a function of forming a visual image from the latent image formed in the film F by keeping the film F to a temperature equal to or higher than a lowest thermal development temperature for a predetermined thermal development time. The lowest thermal development temperature denotes a lowest temperature, at which the latent image formed in the film F starts to be thermally developed, and is equal to or higher than 80° C. for the film of this embodiment. The thermal development time denotes the period of time required to maintain the film F to a temperature equal to or higher than the lowest thermal development temperature to develop the latent image of the film F to a desired development degree. Preferably, the film F is not substantially thermally developed at a temperature equal to or lower than 40° C.

Figure 8:
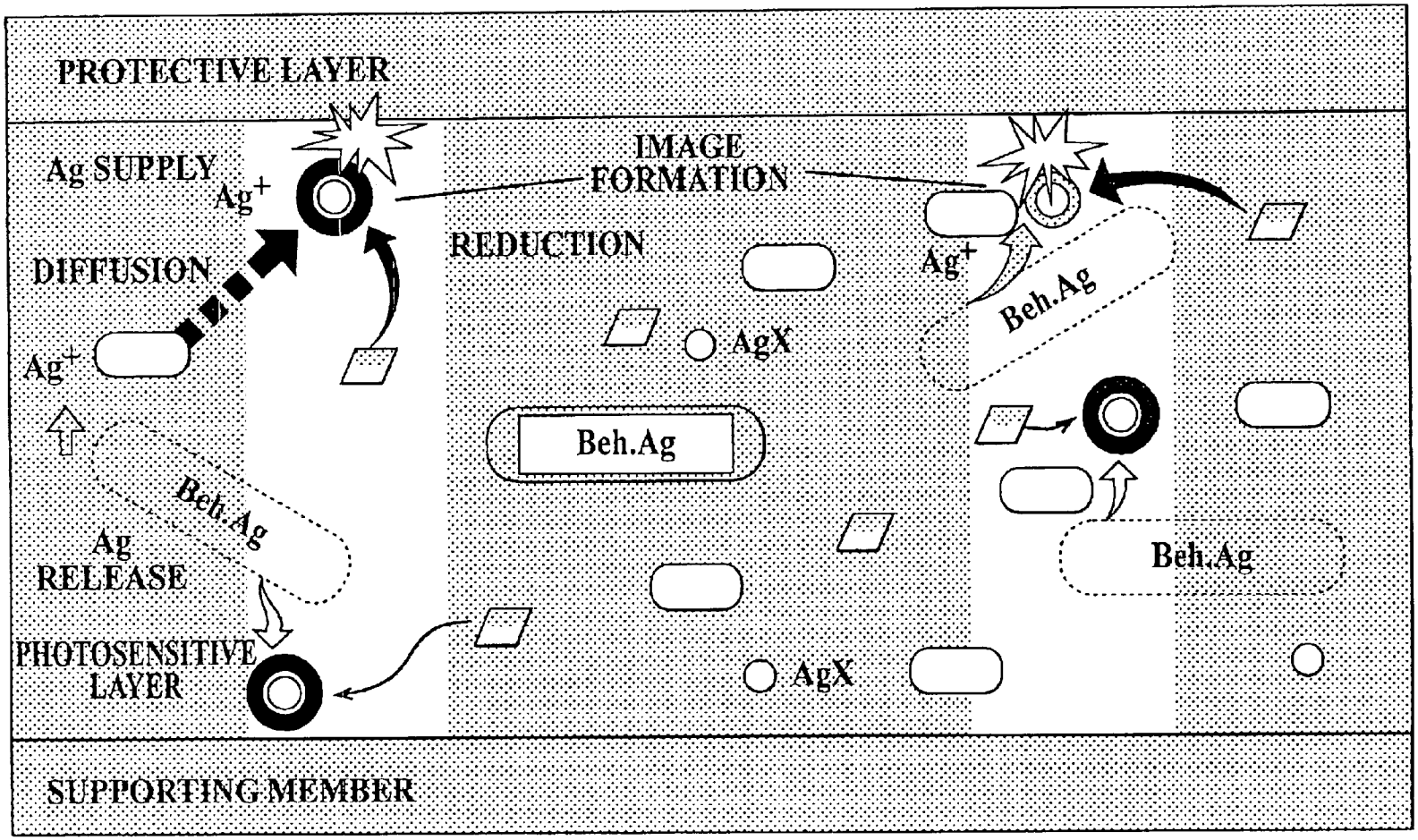
FIG. 8 is a sectional view of the film according to the embodiment and schematically shows the chemical reaction in the film when the film having a latent image shown in FIG. 7 is heated.

The chemical reaction of visualizing the latent image by the heating of the film F described above will be explained in detail with reference to FIG. 8. FIG. 8 is a sectional view, similar to FIG. 7, schematically showing the chemical reaction in the film when the film is heated.

When the film F is heated up to a temperature equal to or higher than a lowest thermal development temperature, as shown in FIG. 8, silver ions ($Ag^+$) are dissociated from silver behenate, and behenic acid obtained by dissociating the silver ions forms toning agent and complex. Thereafter, the silver ions are dispersed, and reducing agent with photosensitized silver halide particles acts as nucleuses on the film F. Therefore, silver image is formed due to the above-described chemical reaction. The film F includes photosensitive silver halide particles, organic silver salt and silver ion reducing agent. The film F is not substantially thermally developed at the temperature equal to or lower than 40° C. and is thermally developed at the temperature equal to or higher than 80° C. denoting the lowest thermal development temperature.

In this embodiment, the thermal development section 130 and the exposure section 120 are arranged in the same thermal development apparatus 100. However, an apparatus having the thermal development section 130 may differ from an apparatus having the exposure section 120. In this case, a carrying section is preferably arranged to carry the film F from the exposure section 120 to the thermal development section 130.

As shown in FIGS. 4, 5 and 6, a plurality of rotatable opposed rollers (pressing rollers) 16 having a small diameter are arranged on the outer circumferential side of the heating drum 14 as a guide member and an opposing member. The opposed rollers 16 are parallel to and is opposed to the heating drum 14 and are placed at equal intervals along the outer circumferential surface of the heating drum 14. Each opposed roller 16 is made of an aluminum tube having the outer diameter of 1 cm to 2 cm and the thickness of 2 mm.

Three guide brackets 21 supported by a flame 18 is arranged at each of both ends of the heating drum 14. The three guide brackets 21 are combined with one another to be formed in a C shape, and the C-shaped members are opposed to each other at both ends of the heating drum 14.

The guide brackets 21 hold the opposed rollers 16 at both ends of the heating drum 14, and the holding position of the guide brackets 21 can be adjustable. That is, relative positions of the opposed rollers 16 to the heating drum 14 can be simultaneously adjusted by adjusting the positions of the guide brackets 21. Thereby, the parallelism between the heating drum 14 and each opposed roller 16 in the axial direction of the heating drum 14 can be appropriately adjusted. Accordingly, the film F can be tightly in contact with the outer circumferential surface of the heating drum 14. Particularly, as described later, when a smooth layer of fluororesin or the like is arranged on the outer circumferential surface of the heating drum 14, the deviation from the positional relation between the heating drum 14 and each opposed roller 16 parallel to each other easily causes the unevenness in the density of the image. However, because the parallelism is adjustable, the unevenness in the density of the image can be prevented.

In each guiding bracket 21, nine long holes 42 radially extending are formed. Two shafts 40 arranged at both ends of each opposed roller 16 respectively are protruded from the corresponding two long holes 42 respectively. One end of a coil spring 28 is fitted to each shaft 40, and the other end of each coil spring 28 is fitted to an inner portion of the corresponding guiding bracket 21 near to the inner end. Therefore, each opposed roller 16 presses the outer circumferential surface of the heating drum 14 due to the biasing force of the corresponding coil spring 28. When the film F is put between the outer circumferential surface of the heating drum 14 and the opposed roller 16, the film F is pressed toward the outer circumferential surface of the heating drum 14 at predetermined force, and the heating drum 14 uniformly heats the entire film F.

A shaft 22 coaxially connected with the heating drum 14 extends outward from an end member 20 of the flame 18 and is supported by a shaft bearing 24 so as to be ratatable on the end member 20. A gear (not shown) is formed on a rotor 23 of a micro step motor (not shown) placed below the shaft 22 and fitted to the end member 20. A gear is also formed on the shaft 22. Driving power generated in the micro step motor is transmitted to the shaft 22 through a timing belt (a belt with a gear) 25 connecting the gear of the rotor 23 and the gear of the shaft 22, and the heating drum 14 is rotated by the transmitted driving power. The driving power may be transmitted from the rotor 23 to the shaft 22 through a chain or a series of gears.

As shown in FIG. 5, in this embodiment, the opposed rollers 16 are placed along the outer circumferential surface of the heating drum 14, and two reinforcement members 30 (shown in FIG. 6) connect both the end members 20 of the frame 18 to additionally support both the end members 20.

A plate-shaped heater 32 is arranged along the entire inner surface of the heating drum 14 and heats the outer circumferential surface of the heating drum 14 under control of an electronic control device 34 shown in FIG. 6. Electric power is supplied to the heater 32 through a slip ring assembly 35 connected with the electronic device 34.

The heater 32 is placed along the inner surface of the heating drum 14 to heat the outer circumferential surface of the heating drum 14. A foil heater having etched foil resistance part can be, for example, applied as the heater 32 to heat the heating drum 14.

The electronic device 34 for heater control is rotated along with the heating drum 14 and can adjust the electric power supplied to the heater 32 according to information of the temperature which is detected by a temperature detecting means placed on the heating drum 14. The electronic device 34 controls the heater 32 to adjust the outer circumferential surface of the heating drum 14 to the temperature appropriate to the developing of the specific film F. In this embodiment, the heating drum 14 can be heated up to 60° C. to 160° C.

The range of temperature variance in the width direction of the heating drum 14 is preferably maintained within 2.0° C. (more preferably within 1.0° C.) by the heater 32 and the electronic apparatus 34. In this embodiment, the range is maintained within 0.5° C.

As shown in FIG. 5, the heating drum 14 comprises a rotatable supporting tube (base body) 36 formed in a cylindrical shape and made of aluminum, a softened elastic layer 38 made of silicon rubber or the like and placed outside of the supporting tube 36 and a smooth layer 39 which is formed by coating the elastic layer 38 with fluororesin and denotes the outermost surface of the heating drum 14.

The thickness and conductivity of the elastic layer 38 is determined so as to effectively and successively process a plurality of films F. The thermal conductivity of the elastic layer 38 is preferably equal to or more than 0.5 W/k. The stiffness of the elastic layer 38 preferably ranges from 20 to 70 degrees in stiffness based on the Japanese Industrial Standard-A (JIS-A). The elastic layer 38 may be indirectly fitted to the supporting tube 36.

The elastic layer 38 is made of rubber or rubber-like material. The rubber or the rubber-like material is selected from various types rubber material, thermoplastic elastomer and various types of material having the same elasticity as the rubber material. For example, material selected from or mixed material obtained from the rubber material, various types resin material, thermoplastic elastomer and the like may be used as the material of the elastic layer 38. The various types rubber material are defined in wide sense and include material obtained by curing liquid visco-elastic material in liquid reaction, in addition to solid rubber material.

The solid rubber material, for example, includes material obtained by compounding compound chemical such as vulcanizing agent, cross-linking agent, vulcanization accelerator, vulcanization auxiliary agent, tackifier, filler, plasticizer, age resistor, solvent or the like generally used in the rubber industry into polymer selected from or mixed polymer obtained from ethylene-propylene ternary copolymer (EPDM), butyl rubber, polyisobutylene, ethylene-propylene rubber, chloroprene rubber, natural rubber, styrene-butadiene rubber, butadiene rubber, styrene-isobutylene-styrene, styrene-butadiene-styrene, urethane rubber and the like to vulcanize (or cross-link) the polymer or the mixed polymer with the compound chemical.

The liquid visco-elastic material is, for example, selected from urethane, liquid polybutadiene, denatured silicon, silicon, polysulphite and the like. Each of these liquid materials is preferably cured by being mixed with a predetermined amount of curing agent and being reacted with the curing agent, and the cured material is used for the elastic layer 38. The elastic layer 38 may be formed in the density state or sponge shape.

As fluororesin used for the formation of the smooth layer 39, for example, a chemical compound such as polytetrafluoroethylene (PTFE), polychlorotrifluoroethylene (PCTFE), polyvinylidene fluoride (PVDF), copolymer (PFA) of tetrafluoroethylen and perfluoroalkoxiethylene, copolymer (ETFE) of ethylene and tetrafluoroethylene, copolymer of tetrafluoroethylene and hexafluoropropylene (FEP) or the like is used.

When the film F is heated around the heating drum 14 to thermally develop the film F, gas including a chemical component such as organic acid or the like is dissociated from the film F. However, because the fluororesin making the smooth layer 39 placed on the surface of the elastic layer 38 has resistance to chemical reaction, the fluororesin does not chemically react with the dissociated gaseous component such as organic acid or the like. Therefore, the fluororesin does not deteriorate. Further, because the gaseous component cannot permeate the fluororesin, the elastic layer 38 made of silicon rubber or the like is not in contact with the gaseous component such as organic acid or the like. Therefore, the deterioration of the elastic layer 38 due to the gaseous component does not occur. As a result, the shape and/or physical properties of the elastic layer 38 are hardly changed, and the initial elasticity and the thermal conductivity of the elastic layer 38 can be maintained.

Further, the biasing force of the coil springs 28 is determined to set the pressing force of the opposed rollers 16 on condition that the film F is further reliably and tightly in contact with the outer circumferential surface of the heating drum 14 and is stably carried while receiving a sufficient amount of transferred heat. Therefore, the biasing force should be determined. That is, when the biasing force of the coil spring 28 is too small, the film F is unevenly heated. Therefore, there is a probability that the image is imperfectly developed, and there is a probability that the film F is unstably carried.

As shown in FIG. 5, the film F is carried while being nipped by a pair of supply rollers 143 and is supplied to the thermal development section 130 through a guide section 201, and then the film F is sent to the heating drum 14 while being nipped in a nipping area 52 placed between the heating drum 14 and a opposed roller 16*a* placed on the most upstream side. In this case, the relation between the carrying force F1 on the film F in the nipping area 52 and the carrying force F2 of the pair of supply rollers 143 on the film F will be described with reference to FIGS. 10 and 11.

Figure 10:
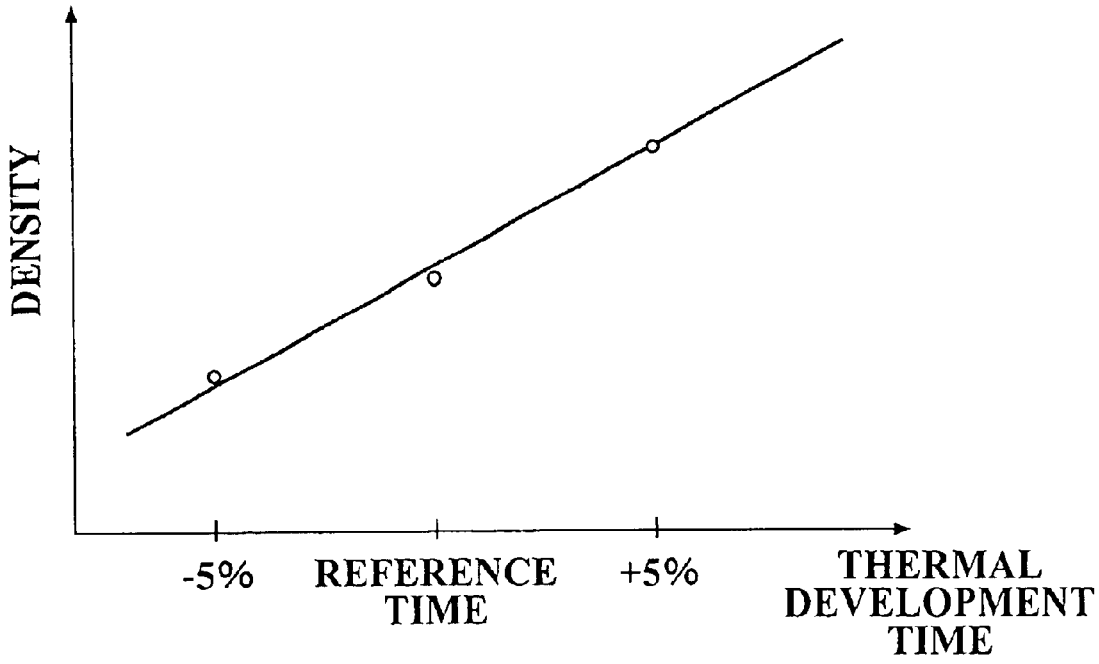
FIG. 10 is a view conceptually showing the influence on the density of the finished image when the thermal development time is changed due to the slipping of the film around the heating drum 14 during the carrying of the film.
Figure 11:
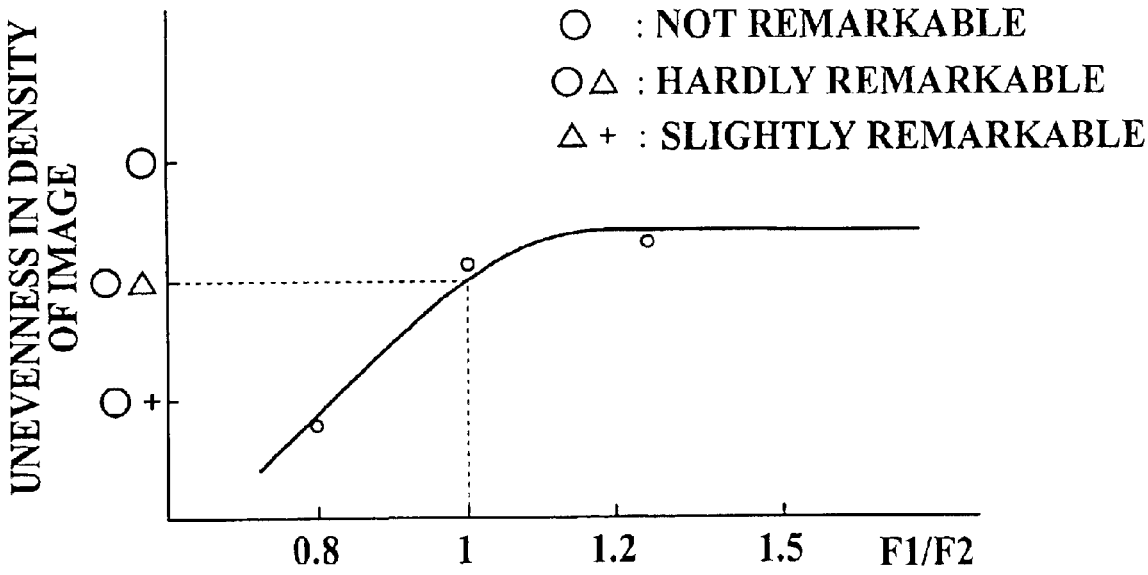
FIG. 11 is a view showing the relation between carrying force F1 on the film F in a nipping area 52 placed between the heating drum 14 and a opposed roller 16*a* placed on the most upstream side and carrying force F2 of a pair of supply rollers 143 on the film F.

FIG. 10 is a view conceptually showing the influence on the density of the finished image when the thermal development time is changed due to the slipping of the film F around the heating drum 14 during the carrying of the film F, and FIG. 11 is a view conceptually showing the relation between the carrying force F1 on the film F and the carrying force F2 generated by the pair of supply rollers 143 on the film F.

As shown in FIG. 10, it is realized that the density of the finished image in the film F is changed in almost proportional to the thermal development time. For example, when the thermal development time is changed by +5% of a reference time, the density is almost linearly increased. When the thermal development time is changed by −5% of the reference time, the density is almost linearly decreased. Therefore, the unevenness of the density in the image is generated due to the change in the density of the image.

As described above, the smooth layer 39 made of fluororesin is formed on the outermost surface of the heating drum 14, and the friction factor of the smooth layer 39 with the film F is smaller than that of an elastic layer made of silicon rubber according to the earlier art. Therefore, the film F is set to an easily slipping condition during the carrying of the film F so as to change the thermal development time and generate the unevenness of the density of the image. However, in the examination performed by the inventors, as shown in FIG. 5, when the top of the film F is nipped in the nipping area 52 placed between the smooth layer 39 placed on the outermost surface of the heating drum 14 and the opposed roller 16*a* placed on the most upstream side while the film F is nipped by the pair of supply rollers 143, it is found out that the unevenness of the density of the image is hardly generated on condition that the ratio (F1/F2) of the carrying force F1 on the film F to the carrying force F2 generated by the pair of supply rollers 143 on the film F is equal to or larger than unity.

That is, when the relation F1/F2≧1 is satisfied, the generation of the unevenness of the density of the image can be effectively prevented. The reason is that the film F is hardly slipped on the smooth layer 39 so as to stably send the film F to the heating drum 14. When the relation F1/F2≧1 is satisfied, the carrying speed of the film F in the thermal development section 130 can be maintained to be higher than that at the pair of supply rollers 143 placed on the upstream side of and nearest to the thermal development section 130, even though the film F is set to the easily slipping condition on the smooth layer 39 made of fluororesin and placed on the outermost surface of the heating drum 14, the film F of the photothermographic imaging material can be stably carried.

The relation F1/F2≧1 can be, for example, obtained by adjusting the coil spring 28 (refer to FIG. 4) which produce the biasing force to make the opposed roller 16*a* placed on the most upstream side press the film F toward the side of the heating drum 13.

Next, the biasing force of the opposed rollers 16 generated by the coil springs 28 and preferable to stably carry the film F through the area between the heating drum 12 and the opposed rollers 16 will be described with reference to FIGS. 12 and 13.

Figure 12:
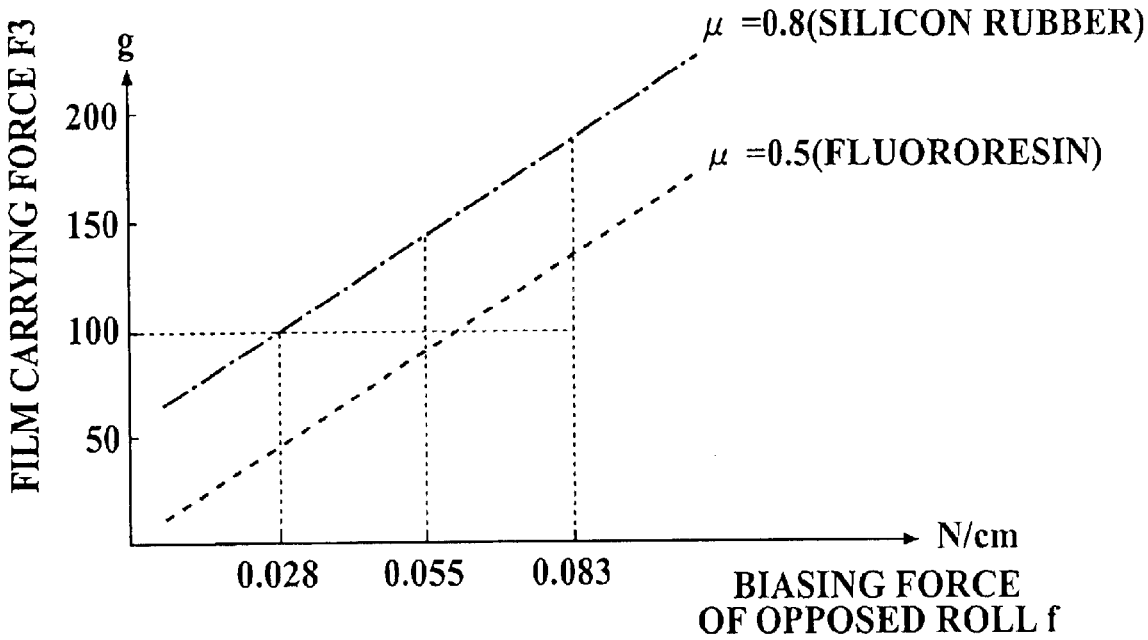
FIG. 12 is a view showing the relation between biasing force f of an opposed roller 16 and film carrying force F3 on the heating drum 14.
Figure 13:
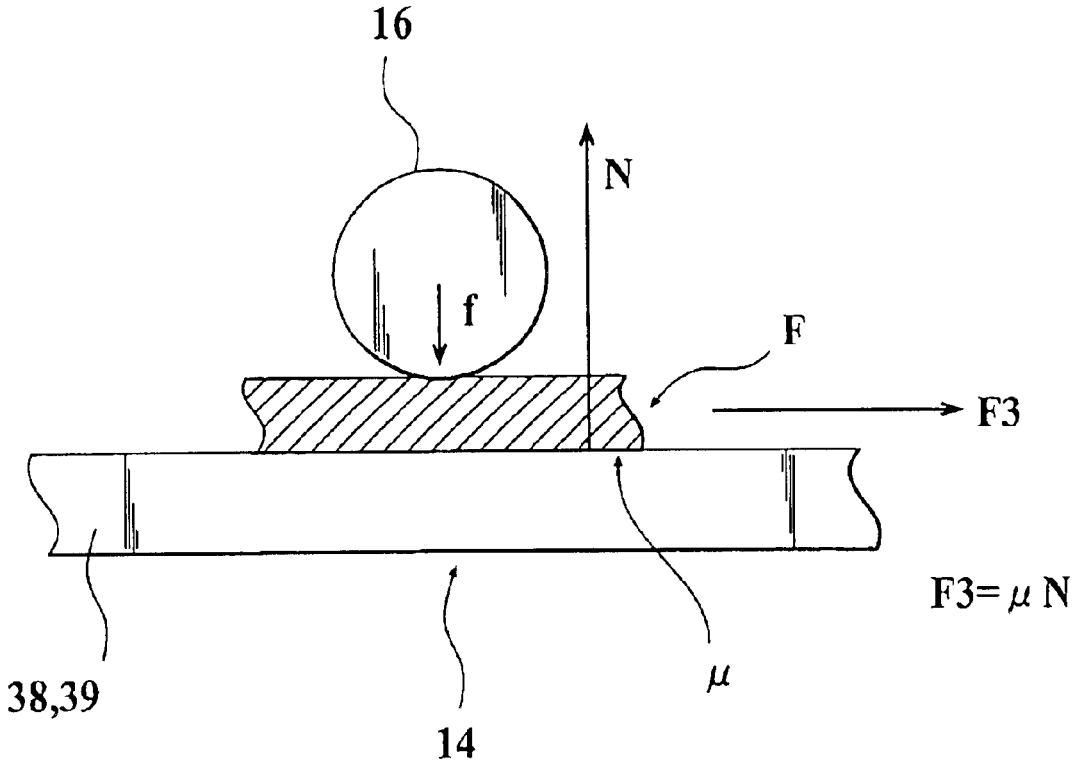
FIG. 13 is a view schematically showing the film F receiving the carrying force F3 by receiving the biasing force f from the opposed roller 16 on the heating drum 14.

FIG. 12 is a view showing the relation between the biasing force f of one opposed roller 16 and the film carrying force F3, and FIG. 13 is a view schematically showing the film F receiving the film carrying force F3 by receiving the biasing force f from the opposed roller 16. In FIG. 12, the relation in case of the friction factor $\mu$=0.8 between the film F and the elastic layer made of silicon rubber is shown in addition to the relation in case of the friction factor $\mu$=0.5 between the film F and the smooth layer 39 made of fluororesin.

As shown in FIG. 13, when the film F receives the biasing force f from the opposed roller 16, the film carrying force F3 on the film F is generated. The film carrying force F3 is determined according to the friction factor i between the film F and the smooth layer 39 denoting the contact surface.

$$F3=\mu N$$

To stably carry the film F, the film carrying force F3 is preferable to be 100 g or more. Because the friction factor i between the film F and the smooth layer 39 made of fluororesin is approximately 0.5, the relation between the biasing force f of one opposed roller 16 and the film carrying force F3 is the same as that shown in FIG. 12. To obtain the film carrying force F3 of 100 g, as shown in FIG. 12, the biasing force f of one opposed roller 16 is required to be equal to 0.06N/cm. When the width of the opposed roller 16 is equal to 14 inches, the force equal to 2.13N (=0.06N/cm×(14×2.54 cm)) is required. When the weight of the opposed roller 16 is insufficient, the film carrying force F3 may be increased by adjusting the coil spring 28 (refer to FIG. 4) which makes the opposed roller 16 increase the biasing force by working for the opposed roller 16 at both ends of the opposed roller 16.

Therefore, the biasing force of the opposed roller 16, which is determined by both the coil spring 28 (refer to FIG. 4) making the opposed roller 16 press the heating drum 14 and the weight of the opposed roller 16, is preferably adjusted to 0.06N/cm or more. On the other hand, it is required that the biasing force is lowered to prevent the opposed roller 16 from generating flaws on the film F. In view of this requirement, the biasing force of the opposed roller 16 preferably ranges from 0.06N/cm to 1N/cm. Further, as a result of further examination of the inventors, the biasing force of the opposed roller 16 further preferably ranges from 0.1N/cm to 1N/cm to improve the contact of the film F with the smooth layer 39 of fluororesin and to efficiently supply the heat from the heating drum 14 to the film F.

Because the heating drum 14 can move at the almost same speed as the film F to be developed, the probability of the generation of flaws (wear and tear, damage) on the surface of the film F is lowered, and the image of the high quality can be obtained. After carrying the film F to between the heating drum 14 and the opposed roller 16, the developed film F is guided to a nipping area 50 which is placed between the heating drum 14 and the opposed roller 16*b* placed on the most downstream side and acting as a guide member of the just-before-separation. And then, as described later, the film F is drawn out from the heating drum 14 of the thermal development section 130.

For example, the thermal development section 130 develops the film F in which polyethylene terephthalate (PET) having the thickness of 0.178 mm and acting as a supporting member is coated with photoresistive thermal developing emulsion including infrared ray photosensitive silver halide. The heating drum 14 is maintained to the temperature from 115° C. to 138° C., for example, 124° C. and is rotated at a rotation speed to hold the film F on the outer circumferential surface of the heating drum 14 for a predetermined time such as almost 15 seconds in contact state. The film F is heated up to 124° C. in the above-described predetermined time and the temperature of the heating drum 14. The glass-transition temperature of PET is equal to almost 80° C.

Figure 15:
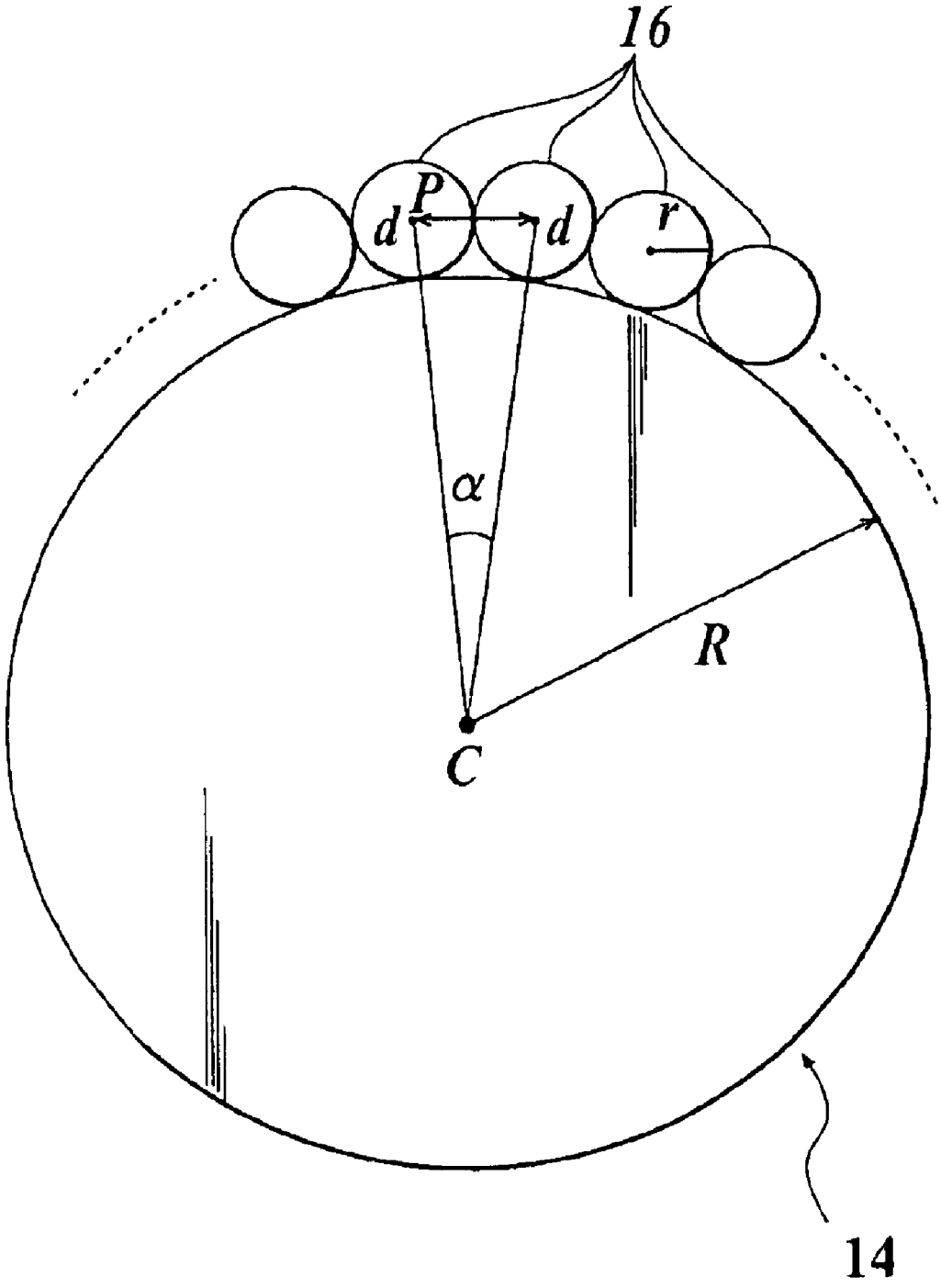
FIG. 15 is a side view of a plurality of opposed rollers arranged so as to be opposite to the heating drum shown in FIG. 1.

Next, the arrangement and configuration of the opposed rollers 16 will be described with reference to FIG. 15. FIG. 15 is a side view of the plurality of opposed rollers (pressing rollers) 16 arranged so as to be opposite to the heating drum 14.

Each opposed roller 16 is arranged so as to make a pitch P of the opposed roller 16 and a contact angle β (degrees) of the film F to the opposed roller 16 satisfy following formula and relations (1), (2) and (3).

$$P=2\pi R\alpha/360 \quad (1)$$

$$2r+3\geqq P>2r \quad (2)$$

$$\beta\leqq 60 \quad (3)$$

Referring to FIG. 15, R (mm) denotes the radius of the heating drum 14, r (mm) denotes the radius of the opposed rollers 16, α (degrees) denotes the angle between lines respectively connecting the center C of the heating drum 14 and centers c of two opposed rollers 16 adjacent to each other, and P (mm) denotes the pitch of the opposed rollers 16. Further, referring to FIG. 16, when the film F is carried by the rotation of the heating drum 14 directed in the rotational direction S, β denotes the angle between the film F going out from one upstream opposed roller 16 and a tangent line m of the sectional circle of one downstream opposed roller 16, which is placed on the downstream side of the upstream opposed roller 16, at a contact position at which the top Fa of the film F comes in contact with the downstream opposed roller 16.

When the formula and relation (1) and (2) are satisfied, the opposed rollers 16 can be arranged so as to be densely close together at the circumferential surface of the heating drum 14, and the positional relation between the opposed rollers 16 and the heating drum 14 prevents the film F from thrashing around the circumferential surface of the heating drum 14. Accordingly, because the film F is pressed by each opposed roller 16 and is stably carried while being tightly in contact with the heating drum 14, the unevenness in the density of the image can be prevented.

When the relations (2) and (3) are satisfied, the top Fa of the film F can further approach the heating drum 14. Accordingly, the film F can be sufficiently heated, and the insufficient density at the top area of the film F can be prevented.

Figure 17A:
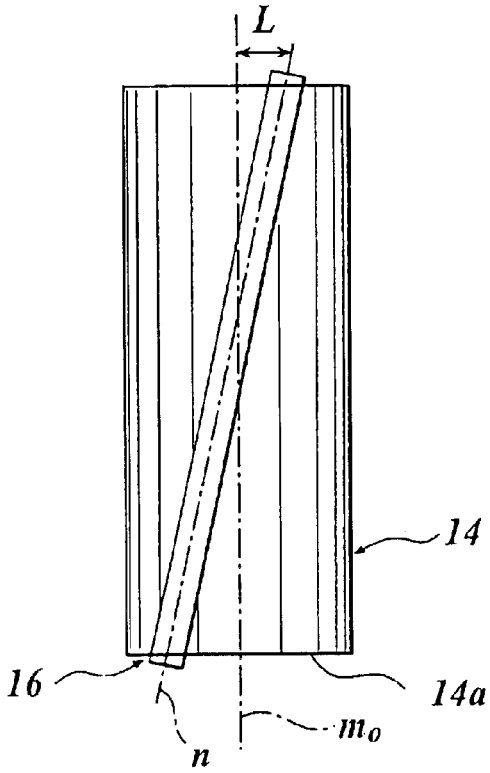
FIG. 17A is a plan view showing a deviation of the central line of the opposed roller from the axial line of the heating drum to indicate the parallelism between the heating drum and the opposed roller.
Figure 17B:
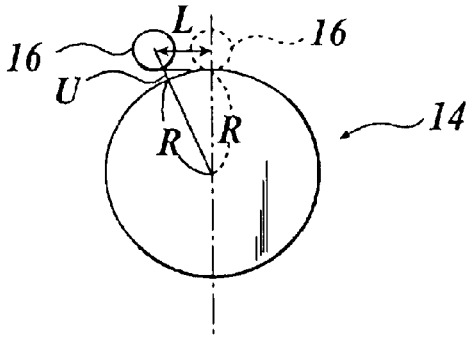
FIG. 17*b* is a side view showing the departing of the opposed roller from the heating drum 14 caused by the deviation of the opposed roller.
Figure 17C:
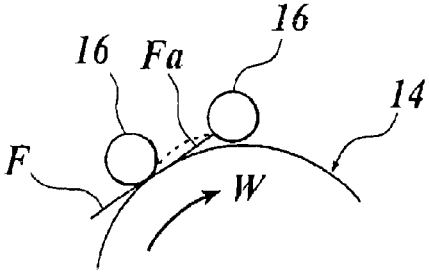
FIG. 17C is a partial side view showing the film carried on the rotated heating drum.
Figure 18:
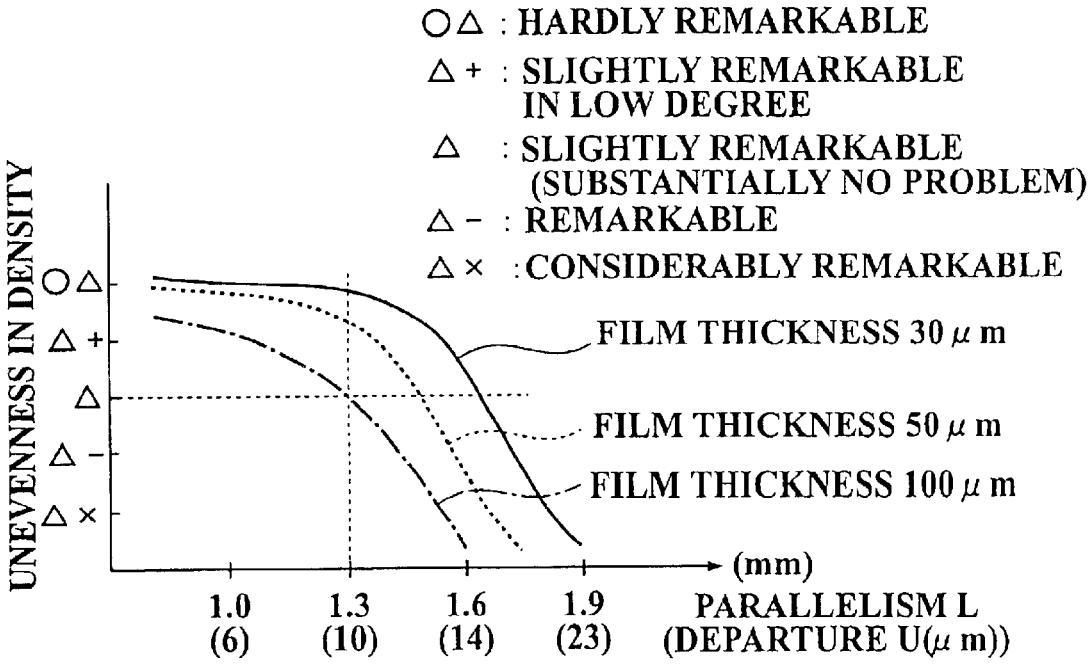
FIG. 18 is a view showing the relation between the deviation (departure) of the opposed roller shown in FIGS. 17A and 17B and the unevenness in the density of the image.

Next, the parallelism between the heating drum 14 and each opposed roller 16 will be described with reference to FIGS. 17A, 17B and 17C and FIG. 18. FIG. 17A is a plan view showing a deviation of the central line of the opposed roller from the axial line of the heating drum to indicate the parallelism between the heating drum and the opposed roller, FIG. 17B is a side view showing the departing of the opposed roller from the heating drum 14 caused by the deviation of the opposed roller, and FIG. 17C is a partial side view showing the film carried on the rotated heating drum. FIG. 18 is a view showing the relation between the deviation of the opposed roller shown in FIGS. 17A and 17B and the unevenness in the density of the image. In FIGS. 17A, 17B and 17C, only one or two opposed rollers are shown for convenience of explanation, and the deviation and departure of the opposed roller is exaggeratedly shown.

As shown in FIG. 17A, each opposed roller 16 is arranged in parallel to the heating drum 14 so as to extend in the direction of the axial line (central line) $m_0$ of the heating drum 14, and the opposed roller 16 is in contact with the outer circumferential surface of the heating drum 14 as shown by a broken line of FIG. 17B. However, as shown in FIG. 17A, when the opposed roller 16 is deviated from the axial line $m_0$ of the heating drum 14 not to be parallel to the heating drum 14, as shown in FIG. 17B, the opposed roller 16 departs from the outer circumferential surface of the heating drum 14. Particularly, the opposed roller 16 considerably departs from each end 14*a* of the heating drum 14. A departure U of the opposed roller 16 from the end 14*a* of the heating drum 14 can be expressed according to a formula (4).

$$U=(R^2+L^2)^{0.5}-R \tag{4}$$

R denotes a radius of the heating drum 14. L denotes a deviation (a distance from the central line n of the opposed roller 16 to the axial line $m_0$ at the end 14*a* of the heating drum 14) of the opposed roller 16 from the heating drum 14.

In the examination of the inventors, when the opposed roller 16 is not parallel to the axial line $m_0$, the opposed roller 16 cannot press the film F. Therefore, the film F is difficult to follow the shape of the heating drum 14, and the film F easily departs from the heating drum 14. In case of the heating drum of which the outermost surface portion is made of silicon rubber according to the earlier art, the film is in point-contact with a very large number of points of the outer circumferential surface of the heating drum. Therefore, even though the film becomes depart from the surface of the heating drum, the departing of the film from the surface of the heating drum influences on the temperature of the film in comparatively small degree. In contrast, the film 14 is in plane-contact with the smooth layer 39 made of fluororesin, and the departing of the film F from the surface of the heating drum 14 influences on the temperature of the film F in larger degree than that in the earlier art. Therefore, the inventors found out that the departure U is preferably equal to or lower than a predetermined value. For example, in case of the heating drum having the diameter of 160 mm and having the outer circumferential surface coated with Teflon (trade name), when the parallelism (deviation L) of the opposed roller 16 is maintained within 1 mm, the departure U is set to be equal to or lower than 6 μm.

In case of the occurrence of the departing of the opposed roller 16 from the heating drum 14, when the top Fa of the film F collides with the opposed roller 16 in the carrying of the film F while rotating the heating drum 14 in a rotational direction W, as shown in FIG. 17C, the film F is deformed so as to follow a locus indicated by a broken line, and the film F is inclined to depart from the surface of the heating drum 14. Because of the departing of the film F, the film F is difficult to be heated, and the image having an insufficient density is undesirably obtained. Further, when the collision angle of the film F with the opposed roller 16 is large, the film F easily departs from the heating drum 14. In contrast, as described above, when the departure U of the opposed roller 16 is suppressed at the end 14*a* of the heating drum 14 within the prescribed value, the departing of the film F from the heating drum 14 can be effectively prevented. Accordingly, the change in the density of the image such as an insufficient density and the unevenness in the density of the image can be suppressed.

As shown in FIG. 18, in the thermal development apparatus shown in FIGS. 1 to 6, the deviation L of each opposed roller 16 from the heating drum 14 is changed, and the film thickness of the smooth layer 39 of the heating drum 14 is changed to 30 μm, 50 μm and 100 μm. As a result, the larger the deviation L is, the more the unevenness in the density of the image is generated. Further, the thicker the film thickness is, the easier the unevenness in the density of the image is generated. By the judging criterion that the unevenness in the density of the image is practically allowed though the unevenness in the density of the image slightly attracts attention, the deviation L is preferably equal to or lower than 1.3 mm at the film thickness of the smooth layer 39 set to 100 μm. In FIG. 18, the departure U is indicated in parentheses of X-axis together with the deviation L. The departure U is preferably equal to or lower than 10 μm at the film thickness of the smooth layer 39 set to 100 μm.

Further, the deviation L (the departure U) is preferably equal to or lower than 1.5 mm (14 μm) at the film thickness of the smooth layer 39 set to 50 μm, and the deviation L (the departure U) is preferably equal to or lower than 1.7 mm (18 μm) at the film thickness set to 30 μm. The size of the heating drum 14 can be set to have the diameter of 160 mm and the length of 400 mm in the direction of the axial line. However, this embodiment is not limited to this. In view of preventing the influence of gas generated in the developing of the film F on the elastic layer 38, the film thickness of the smooth layer 39 made of fluororesin is equal to or larger than 10 $\mu$m, preferably ranges from 10 $\mu$m to 100 $\mu$m, and more preferably ranges from 10 $\mu$m to 60 $\mu$m.

Moreover, as described above, because the relative positions of the opposed rollers 16 to the heating drum 14 can be adjusted together by adjusting the position of the guiding bracket 21, the deviation L and the department U of each opposed roller 16 can be set together within the prescribed range by adjusting the opposed rollers 16 together.

As described above, because of the smooth layer 39 formed on the outermost surface of the heating drum 14 and made of fluororesin, the deterioration of the elastic layer such as silicon rubber caused by gas generated in the developing of the film F can be prevented. Further, the parallelism (the departing of the opposed rollers 16) between the opposed rollers 16 and the heating drum 16 is adjusted within a predetermined amount and is set within the prescribed range at the position at which the tight contact of the film F with the heating drum 14 having the smooth layer 39 is particularly required to prevent the unevenness in the density of the image. Accordingly, the unevenness in the density of the image can be effectively prevented.

Figure 9:
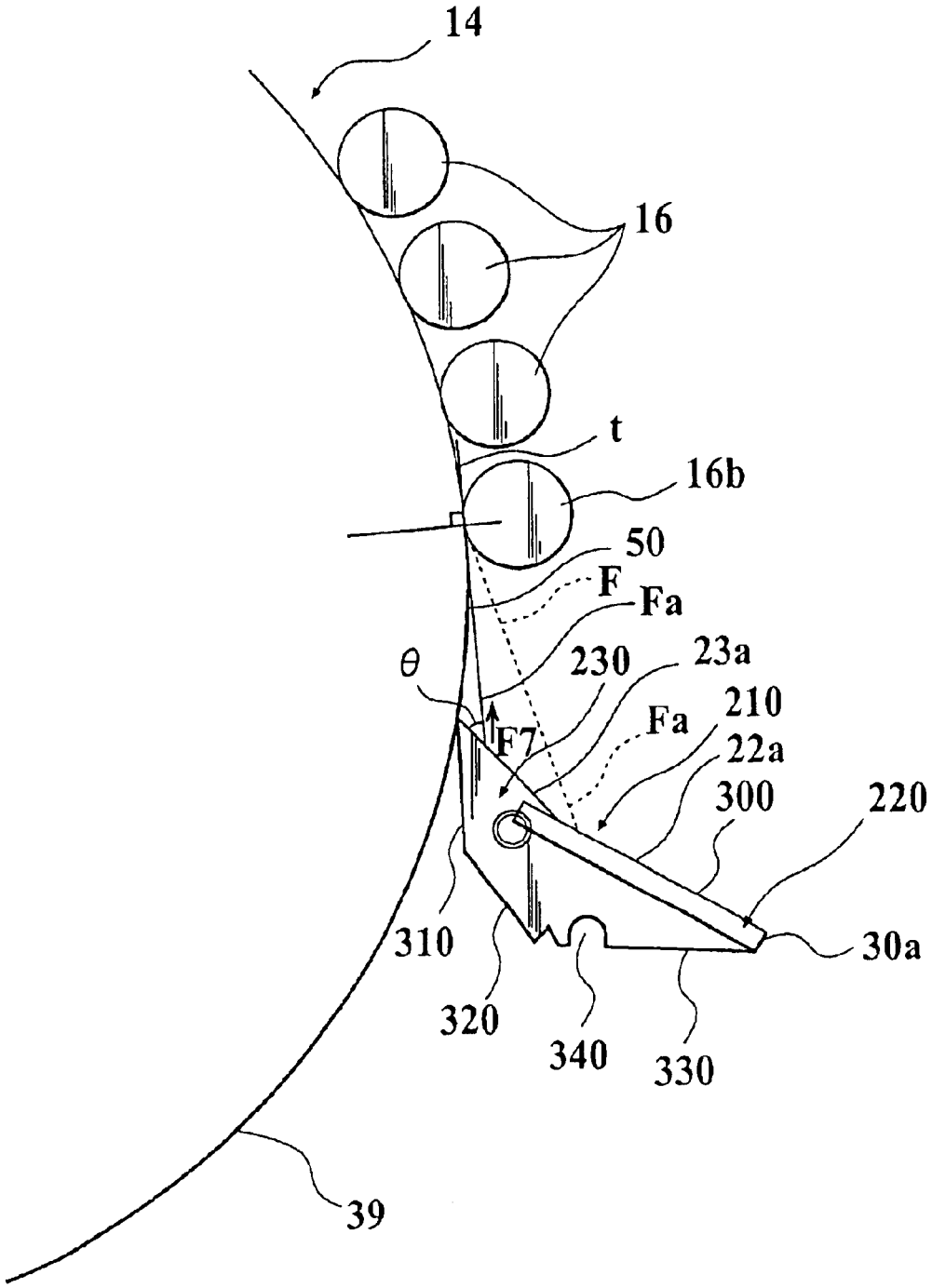
FIG. 9 is a front view showing a guide member and a carrying roller arranged in the neighborhood of a heating drum (heating section) 14 on the downstream side.

Next, a guide member for first guiding the film F separated from the heating drum 14 of FIG. 5 will be described with reference to FIG. 9. FIG. 9 is a front view showing the guide member and a carrying roller arranged in the neighborhood of the heating drum 14.

As shown in FIGS. 5 and 9, a guide member 210 separating the film F from the heating drum 14 and guiding the film F in the carrying direction is arranged between the heating drum 14 and the pair of carrying rollers 144*a* and below the opposed roller 16*b* placed on the most downstream side. That is, the guide member 210 is arranged so as to first guide the film F along a guide surface 300 of the guide member 210 after the film F is carried between the heating drum 14 and the opposed rollers 16 and is separated from the smooth layer 39 placed on the outermost circumferential surface of the heating drum 14.

As shown in FIG. 9, the guide member 210 comprises a first member 220 made of insulating material such as resin material, non-woven cloth or the like, and a second material 230 made of metallic material such as aluminum or the like having high thermal conductivity and integrally formed with the first member 220 under the first member 220. The guide surface 300 of the guide member 210 comprises a first guide surface 23*a* of the second member 230 first coming in contact with the film F, and a second guide surface 22*a* of the first member 220 of the insulating material secondly coming in contact with the film F.

Further, the guide member 210 comprises a first inclined surface 310 placed on the opposite side of the guide surface 300, a second inclined surface 320 and a third inclined surface 330. The first inclined surface 310, the second inclined surface 320 and the third inclined surface 330 are successively formed so as to direct the inclination direction of the guide member 210 from the lower direction of the gravity to the inclined direction in that order.

The first inclined surface 310 of the guide member 210 is arranged closest to the heating drum 14 on the opposite side of the guide surface 300, is inclined so as to go away from the smooth layer 39 of the heating drum 14 and is directed toward the almost lower direction of the gravity. The second inclined surface 320 is inclined from the gravity direction. The third inclined surface 330 is directed to the almost horizontal direction.

The right end of the third inclined surface 330 in FIG. 9 is near to a film outlet 30*a* of the guide surface 300. A liquid holding unit 340 is formed in a groove shape in the middle of the third inclined surface 330. The surface roughness of the inner groove surface of the liquid holding unit 340 is equal to or larger than Ra=1 $\mu$m and is equal to or larger than Rz=10 $\mu$m.

As shown in FIG. 9, the first, second and third inclined surfaces 310, 320 and 330 are placed on the opposite side of the guide surface 300 of the guide member 210 arranged close to the heating drum 14, and the guide member 210 is formed in the inclined structure. Therefore, even though a body adhering to the guide member 210 is generated by the repeated cohesion and re-melting of gaseous components which are generated by heating the film F in the thermal development section 130, the gaseous components hardly approach the smooth layer 39 of the heating drum 14. Therefore, the heating drum 14 is hardly damaged. Further, when the gaseous components repeatedly cohering to one another and re-melting are liquidized, the liquidized components flow onto the second inclined surface 320 and the third inclined surface 330. Accordingly, because it is difficult that the body adhering to the guide member 210 largely grow, the smooth layer 39 of the heating drum 14 is hardly damaged.

As shown in FIG. 1, in the thermal development section 130, gas such as higher fatty acid or the like is dissociated from the film F in the developing processing of the film F, and the film F softened after the developing processing can be stably guided to the cooling and carrying section 150A in the next process by using the guide member 210 of FIG. 9 arranged to be close to the heating drum 14.

In the earlier art, the guide member made of metallic material is easily cooled after the stopping of the developing processing. Therefore, when gas such as fatty acid or the like is dissociated from the film F, the gaseous components easily cohere to one another and adhere to one another. Further, when the reprocessing is started, the gaseous components once cohering to one another re-melt to form large accumulated bodies, and the cohesion and the re-melting of the gaseous components is repeated to form a very large accumulated body. In this case, there is probability that the very large accumulated body finally comes in contact with the heating drum 14 to give damage to the heating drum 14. In contrast, as shown in FIG. 9, the guide member 210 has the inclined structure in which the inclined surfaces 310 to 330 placed on the opposite side of the guide surface 300 gradually go away from the smooth layer 39 of the heating drum 14. Therefore, even though the gaseous components such as fatty acid or the like generated in the developing processing of the film F cohere to one another and adhere to the first inclined surface 310 and/or the like, the heating drum 14 is hardly damaged.

Further, even though the liquidized gaseous components repeatedly cohering to one another and re-melting flow onto the second inclined surface 320 and the third inclined surface 330, the liquidized components are held in the liquid holding unit 340 arranged on the third inclined surface 330. When the volume of the liquidized components exceeds a predetermined value, the liquidized components fall from the liquid holding unit 340 due to the weight of the liquidized components. Accordingly, the cleaning cycle of the guide member 210 can be prolonged. That is, the necessity of the maintenance work to clean out the guide member 210 with alcohol or the like and to remove the body adhering to the guide member 210 for the purpose of preventing the heating drum 14 from being damaged by the cohering body adhering to the guide member 210 is preferably lowered. Further, the first, second and third inclined surfaces 310 to 330 placed on the opposite side of the guide surface 300 are gradually inclined. Accordingly, even though the maintenance work is performed, the cleaning can be easily performed, and the work can be easily performed.

Moreover, because the second guide surface 22*a* of the guide surface 300 is made of the insulating material of the first member 220 such as resin material, non-woven cloth or the like, the heated film F is not rapidly cooled. Accordingly, the heated and softened film F hardly adheres to the guide surface 300 and hardly acts as an obstacle to the carrying of the film F. Further, the second member 230 having high thermal conductivity is rapidly cooled after the thermal developing processing, and the gaseous components placed around the guide member 210 cohere to one another and adhere to the second member 230. Accordingly, the gas adhering position can be controlled, and the structure of the second member 230 is effective to prevent the heating drum 14 from being damaged.

As shown in FIG. 9, when the film F goes out from the nipping area 50 in between the rotated heating drum 14 and the opposed roller 16*b* placed on the most downstream side, as shown by solid line of FIG. 9, the top Fa of the film F comes in contact with the first guide surface 23*a* of the guide member 210. Thereafter, as shown by broken line of FIG. 9, the top Fa of the film F changes its carried direction and goes ahead so as to move on the second guide surface 22*a*. Thereafter, as shown in FIG. 5, when the film F is nipped in a nipping area between the pair of rollers 144*a*, as shown by broken line of FIG. 5, the film F is separated from the guide member 210 and is carried into the cooling and carrying section 150A of FIG. 1.

In the carrying process of the film F shown in FIGS. 5 and 9, it is preferred that the relation between a carrying speed V1 of the film F in the thermal development section 130 and a carrying speed V2 of the film F on the downstream side of the thermal development section 130 is set to V1<V2. Accordingly, the film F can be stably carried.

Further, it is preferred that the relation between a carrying force F5 generated by the smooth layer 39 of the heating drum 14 and the opposed rollers 16 to carry the film F in the thermal development section 130 and a carrying force F6 to the film F on the downstream side of the thermal development section 130 (in the cooling and carrying section 150A) is set to F5>F6. Accordingly, the film F can be stably carried. Further, because the thermal developing period of time for the film F can be secured while the film F receives a certain tension in the process of cooling the film F to the glass transition point in the cooling and carrying section 150A, the finished image having no wrinkle or no curl can be stably obtained at high quality.

Moreover, as shown by solid line of FIG. 9, it is preferred that a carrying resistance force F7 to the film F coming in contact with the first guide surface 23*a* of the guide member 210 is smaller than the carrying force F5 to the film F in the thermal development section 130, and the carrying resistance force F7 is preferably equal to or lower than 100 g to prevent the unevenness in the density of the image.

Figure 14:
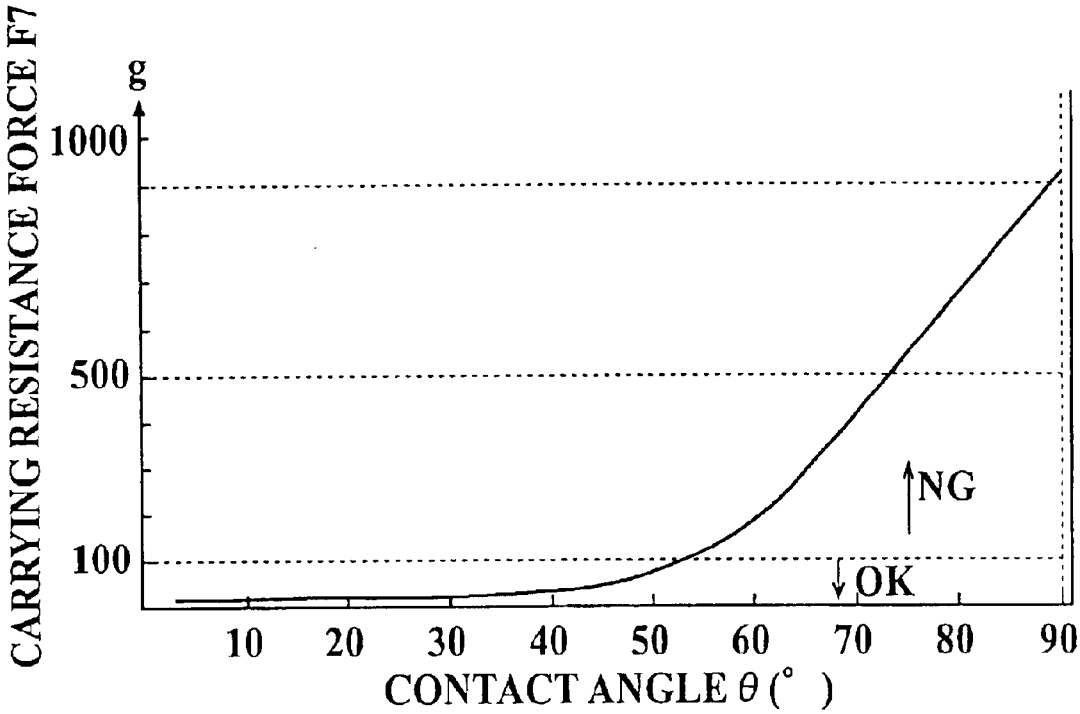
FIG. 14 is a view showing the relation between carrying resistance force F7 given to the film F from the side of a first guide surface 23*a* when the film F comes in contact with the first guide surface 23*a* of a guide member 210 and a contact angle θ of the film F to the first guide surface 23*a;*

FIG. 14 is a view showing the relation between the carrying resistance force F7 given to the film F from the side of the first guide surface 23*a*, when the film F comes in contact with the first guide surface 23*a* of the guide member 210, and a contact angle θ of the film F to the first guide surface 23*a*.

As shown in FIG. 9, the contact angle θ of the film F to a tangent line t touching the heating drum 14 at a point, at which the heating drum 14 is nearest to the first guide surface 23*a* of the guide member 210, changes with the carrying of the film F. As shown in FIG. 14, the carrying resistance force F7 changes with the contact angle θ. Accordingly, the contact angle θ is preferably equal to or lower than 50 degrees and is preferably equal to or higher than 10 degrees to set the carrying resistance force F7 to a value equal to or lower than 100 g. Further, a contacting length of the film F with the first guide surface 23*a* is preferably equal to or lower than 5 mm. The guide member 210 is arranged on the heating drum 14 so as to set the contact angle θ to the range from 10 degrees to 50 degrees.

Further, because the contact angle θ is equal to or lower than 50 degrees, the thermal developing apparatus can be miniaturized in a viewpoint of the arrangement of the guide member 210. Further, because the carrying resistance is not excessive, the stripping of a film from the top Fa of the film F can be suppressed. To suppress the stripping of a film, when the latent image is formed in the film F, it is further preferred that a non-exposed area having the length of 2 mm to 3 mm is set in the top portion of the film F in the film carrying direction and the strength of the film placed between emulsion and base agent is heightened.

As described above, the film can be stably carried on the downstream side of the thermal development section 130, and the locus of the carried film F is stabilized. Accordingly, the curl peculiar to the thermal developing process and the lowering of the density of the image due to the excessive cooling can be suppressed.

Further, the guide member 210 comprises the first guide surface 23*a* of aluminum shaped by the extrusion molding and the second guide surface 22*a* made of non-woven cloth, and the top of the film F separated from the heating drum 14 first comes in contact with the first guide surface 23*a* made of aluminum and is guided. At this time, the surface of the emulsion set to the high temperature state is instantly cooled to heighten the strength of the film. Thereafter, the film F is guided by the second guide surface 22*a* made of non-woven cloth while rotating the heating drum 14. Assuming that the length of the top portion of the film F carried by the first guide surface 23*a* of aluminum exceeds 5 mm, a large curl of the top of the film F is generated due to the excessive cooling, and/or the stripping of the film in the neighborhood of a cut-out surface of the film F occurs. Further, assuming that the film F is directly guided by the non-woven cloth, the position of the film F coming off the heating drum 14 and set to the high temperature and softened state is not stabilized, the ends of the film F does not necessarily come in simultaneous contact with naps of the non-woven cloth, and the curving and three-dimensional twist of the film F easily occurs. However, because the heating drum 14 first comes in contact with the first guide surface 23*a* made of aluminum, the curving and three-dimensional twist of the film F can be suppressed.

The carrying force F6 of the nipping rollers 144*a* can be measured by nipping the top portion of the film F having the width of 14 inches (approximately 35.6 cm) between the nipping rollers 144*a*, attaching a spring balancer or the like to the rear end portion of the film F, driving the nipping rollers 144*a* and reading out a force value indicated by the spring balancer. The carrying force of 100 g denotes that the spring balancer indicates the value of 100 g. In the same manner, the carrying force F5 generated by the heating drum 14 and the opposed rollers 16 can be measured.

As to the carrying resistance of the film F, when the rear end of the film F is pushed by using the spring balancer, the film F is not moved at the start of the pushing. When the load added to the spring balancer is gradually increased and exceeds a certain value, the top of the film F starts to move. At this time, a value of the spring load added to the spring balancer indicates the carrying resistance force F7.

EXAMPLES

Next, the present invention will be further described according to the first example and the second example.

First Example

In the thermal development apparatus shown in FIGS. 1 to 6, the heating drums 14 respectively having the smooth layers 39, which are made of Teflon (trade mark) and have the film thickness of 10 μm, 50 μm, 100 μm and 150 μm respectively, are fabricated, a predetermined image is formed on the film F by using each heating drum 14, and the unevenness in the density of the image is estimated. The estimated result is shown in FIG. 19.

Figure 19:
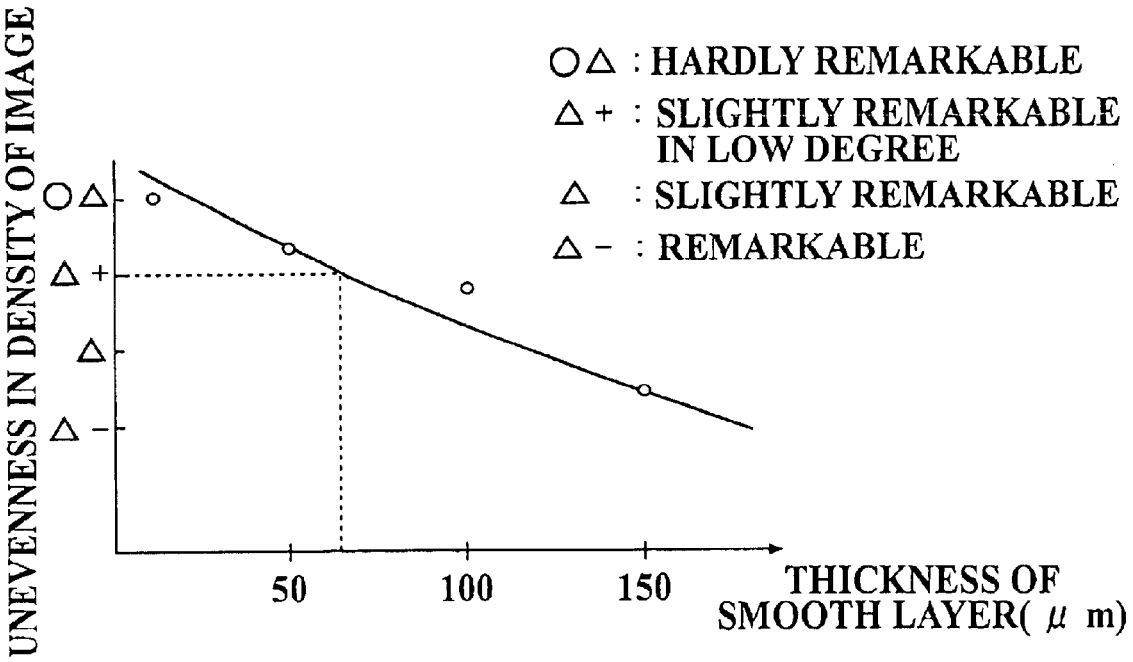
FIG. 19 is a view showing the relation between a film thickness of a smooth layer of the heating drum and the unevenness in the density of the image, in the first example.

As shown in FIG. 19, as the film thickness of the smooth layer 39 becomes larger, the density of the image is changed so as to make the unevenness in the density be further remarkable. In a viewpoint of preventing the deterioration of the elastic layer 38 caused by gas components such as organic acid and the like, the film thickness of the smooth layer 39 is preferably equal to or higher than 10 μm. In a viewpoint of preventing the unevenness in the density of the image, the film thickness of the smooth layer 39 is preferably equal to or lower than 60 μm.

Second Example

Figure 16:
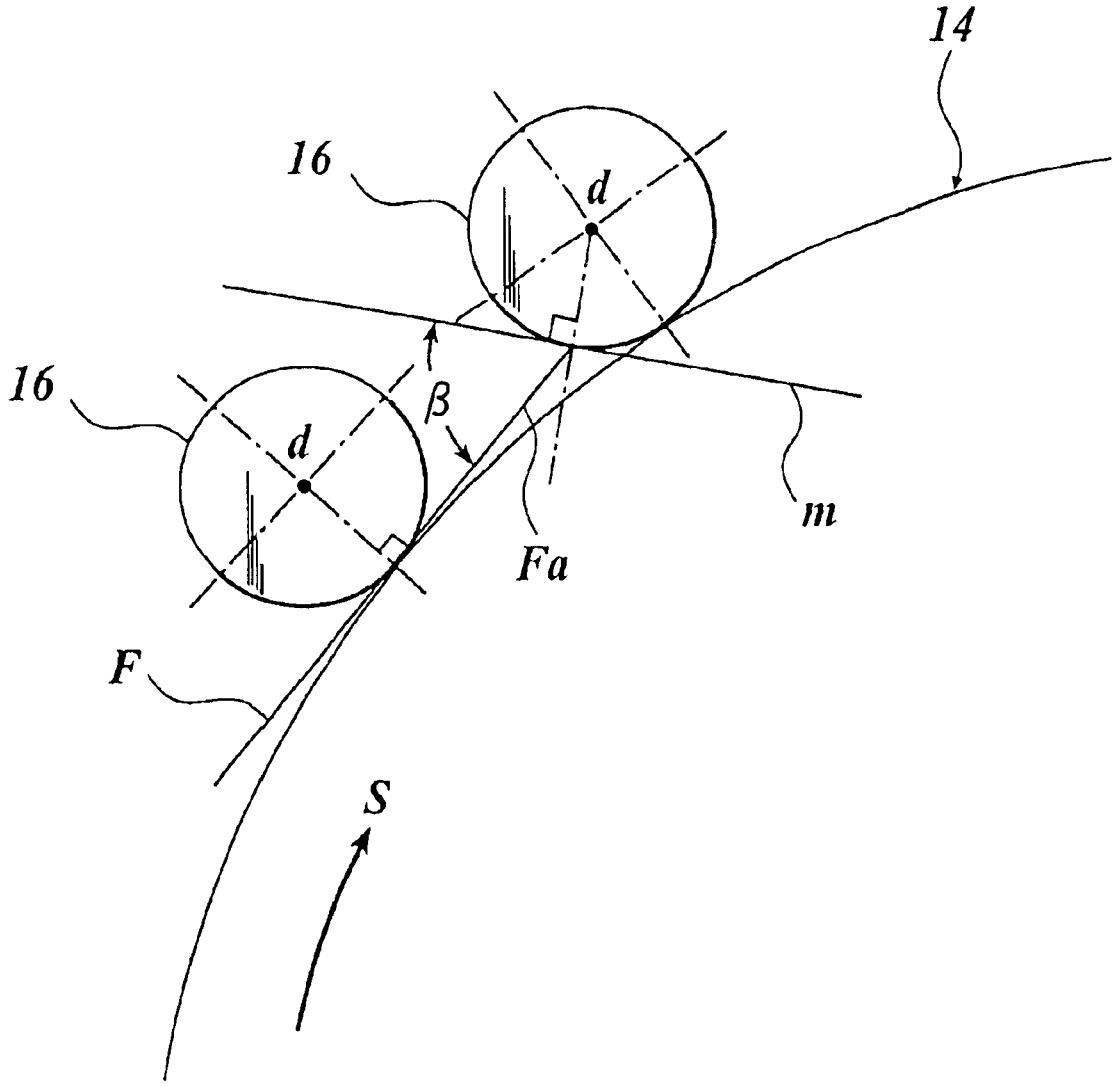
FIG. 16 is a side view of the opposed rollers to explain a contact angle β of the film to the opposed roller on the heating drum shown in FIG. 1.
Figure 20:
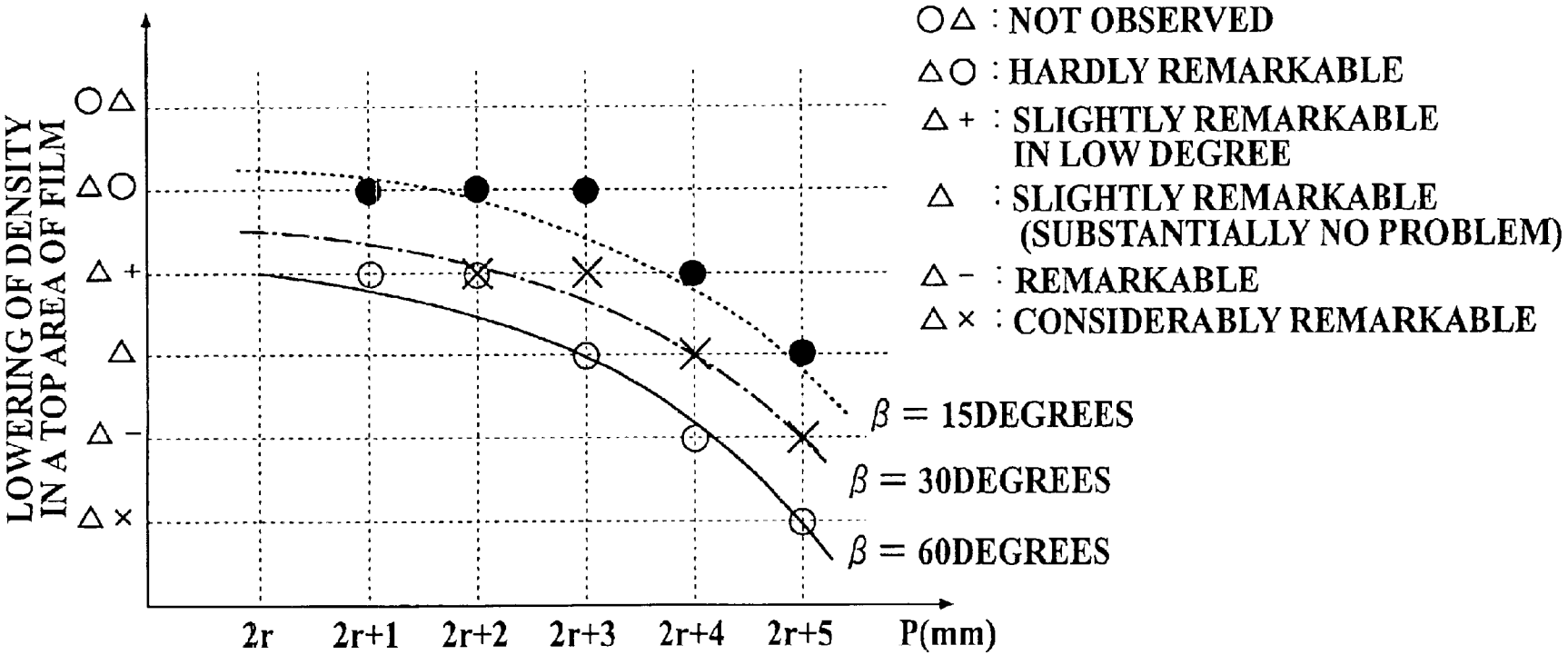
FIG. 20 is a view showing the relation between the pitch P of the opposed rollers and the lowering of the density in the top area of the film, in the second example.

In the heating drum 14 of the thermal development apparatus shown in FIGS. 1 to 6, the pitch P (mm) of the opposed rollers 16 in FIG. 15 is changed to 2r, 2r+1, 2r+2, 2r+3, 2r+4 and 2r+5 mm, and the contact angle β (degrees) of the film F to the opposed roller 16 in FIG. 16 is changed to 15, 30 and 60 degrees. Thereafter, a predetermined image is formed on the film F by using each heating drum 14, and the lowering of the density of the image in the area of the top Fa (refer to FIG. 16) of the film 14 in the carrying direction is estimated. The estimated result is shown in FIG. 20. In this example, the lowering of the density of the image in the area placed from the top Fa of the film 14 to the position away from the top by 20 mm is observed. The radius r of the opposed rollers 16 is set to 12 mm, and the film thickness of the smooth layer 39 of the heating drum 14 is set to 30 μm.

As shown in FIG. 20, as the pitch P of the opposed rollers 16 becomes larger, the lowering of the density of the image becomes remarkable. As the contact angle β becomes larger, the lowering of the density of the image becomes further remarkable. When the contact angle β of the film F to the opposed roller 16 is equal to or lower than 60 degrees and the pitch P of the opposed rollers 16 is equal to or lower than 2r+3, the lowering of the density at the top portion of the film 14 can be prevented on condition that the lowering of the density is practically allowed.

As described above, the present invention is described according to the embodiment and examples. However, modifications may be made to the embodiment without departing from the scope of the invention. For example, the thermal development section 130 and the exposure section 120 are arranged in the same thermal development apparatus 100. However, an apparatus having the thermal development section 130 may differ from an apparatus having the exposure section 120. In this case, a carrying section is preferably arranged to carry the film F from the exposure section 120 to the thermal development section 130.

The entire disclosure of Japanese Patent Applications No. Tokugan 2002-373773 filed on Dec. 25, 2002 including specification, claims, drawings and summary and No. Tokugan 2002-004162 filed on Jan. 10, 2003 including specification, claims, drawings and summary are incorporated herein by reference in its entirety.

What is claimed is:

1. A thermal development apparatus comprising:

a heating section, which has at least a portion of its outer surface formed in an arc shape and has a smooth layer on outermost surface of the arc-shaped portion, for carrying photothermographic imaging material being in contact with the smooth layer on the arc-shaped portion while heating the photothermographic imaging material; and a plurality of opposed rollers, arranged along a carrying path of the photothermographic imaging material carried by the smooth layer on the arc-shaped portion of the heating section, for pressing the photothermographic imaging material against the arc-shaped portion, wherein following formula and relations $$P=2\pi R\alpha/360,$$

$$2r+3\geqq P>2r, \text{ and}$$

$$\beta\leqq 60$$

are satisfied when R (mm) denotes a radius of the arc-shaped portion, r (mm) denotes a radius of the opposed rollers, α (degree) denotes an angle between lines respectively connecting a center of the arc-shaped portion and centers of the two opposed rollers adjacent to each other, P (mm) denotes a pitch of the opposed rollers, and β (degree) denotes a contact angle of the photothermographic imaging material to the opposed roller.

2. The thermal development apparatus of claim 1; wherein the heating section comprises:

a base body;

an elastic layer arranged around the base body and made of an elastic member having thermal conductivity equal to or higher than 0.5 W/k and JIS-A stiffness ranging from 20 degrees to 70 degrees; and the smooth layer formed on the outer surface of the elastic layer and coated with fluororesin.

3. The thermal development apparatus of claim 1; wherein a nipping force of each opposed roller in pressing the photothermographic imaging material to the smooth layer of the heating section ranges from 0.06N/cm to 1N/cm.

4. The thermal development apparatus of claim 1; wherein a thickness of the smooth layer of the heating section ranges from 10 μm to 100 μm.

5. The thermal development apparatus of claim 1; wherein the opposed rollers are supported together by a supporting member, and a position of the supporting member is adjustable relatively to the arc-shaped portion of the heating section.

6. A thermal development apparatus comprising:

a heating section, having a predetermined curvature, for heating photothermographic imaging material; and a plurality of opposed rollers arranged along an axial line of the heating section so as to press the photothermographic imaging material to the heating section, the photothermographic imaging material being developed while being carried between the heating section and each opposed roller, wherein the heating section comprises:

a base body having the predetermined curvature;

an elastic layer arranged around the base body; and a smooth layer arranged on an outer surface of the elastic layer, and wherein parallelism between each opposed roller and the heating section is adjusted within a predetermined amount so that each departure of the opposed rollers from an outer surface of the heating section is kept equal to or lower than a predetermined value.

7. The thermal development apparatus of claim 6; wherein the smooth layer of the heating section is made of fluororesin.

8. The thermal development apparatus of claim 6; wherein a nipping force of each opposed roller in pressing the photothermographic imaging material to the heating section ranges from 0.06N/cm to 1N/cm.

9. The thermal development apparatus of claim 6; wherein a film thickness of the smooth layer ranges from 10 $\mu$m to 100 $\mu$m.

10. The thermal development apparatus of claim 6; wherein the opposed rollers are supported together by a supporting member, and a position of the supporting member is adjustable relatively to the heating section.

11. The thermal development apparatus of claim 6; wherein the predetermined value of the departure is equal to or lower than 10 $\mu$m when a film thickness of the smooth layer is equal to 100 $\mu$m.

12. The thermal development apparatus of claim 6; wherein the predetermined value of the departure is equal to or lower than 14 $\mu$m when a film thickness of the smooth layer is equal to 50 $\mu$m.

13. The thermal development apparatus of claim 6; wherein the predetermined value of the departure is equal to or lower than 18 $\mu$m when a film thickness of the smooth layer is equal to 30 $\mu$m.

* * * * *